US005805532A

United States Patent [19]

Murakami

[11] Patent Number: 5,805,532

[45] Date of Patent: Sep. 8, 1998

[54] TIME INTERVAL MEASUREMENT SYSTEM AND METHOD APPLIED THEREIN

[75] Inventor: Hirokuni Murakami, Kanagawa, Japan

[73] Assignee: NEC Corporation, Tokyo, Japan

[21] Appl. No.: 917,765

[22] Filed: Aug. 27, 1997

[30] Foreign Application Priority Data

Aug. 29, 1996 [JP] Japan ..... 8-228932

[51] Int. Cl.[6] ..... G04F 8/00; G04F 10/00

[52] U.S. Cl. ..... 368/113; 368/118; 377/20

[58] Field of Search ..... 368/107, 113–120; 364/569; 377/20, 21

[56] References Cited

U.S. PATENT DOCUMENTS

| | | | |
|---|---|---|---|
| 4,908,784 | 3/1990 | Box et al. | 364/569 |
| 4,982,350 | 1/1991 | Perna et al. | 364/569 |
| 5,200,933 | 4/1993 | Thornton et al. | 368/113 |
| 5,689,539 | 11/1997 | Murakami et al. | 377/20 |

*Primary Examiner*—Vit W. Miska
*Attorney, Agent, or Firm*—Foley & Lardner

[57] ABSTRACT

A time interval measurement system, by which measurement of individual time interval with remarkably improved measurement accuracy is made possible with smaller circuit scale, comprises a high speed counter section, an adder section, and a control section. The high speed counter section includes a m-bit counter unit having a plurality of m-bit counters for obtaining an integer part of the time interval between a START signal and a STOP signal, a first 1-bit counter unit having a plurality of first 1-bit counters for obtaining an decimal part of the time interval, and a high frequency pulse generator circuit. The high frequency pulse generator circuit periodically generates a plurality of delayed signals at intervals of a unit delay time which is shorter than the cycle time of the clock signal, according to the input of the START signal to the high speed counter section, and supplies each of a plurality of counter stop signals according to the delayed signals to a corresponding m-bit counter in the m-bit counter unit and a corresponding first 1-bit counter in the first 1-bit counter unit.

22 Claims, 19 Drawing Sheets

FIG. 16

| LSD OF $h_1$ | 0 | 1 | 0 | 0 | 1 | 1 | CORRECTION RESULT | | | | | | |
|---|---|---|---|---|---|---|---|---|---|---|---|---|---|
| | EX.1 | EX.2 | EX.3 | EX.4 | EX.5 | EX.6 | EX.1 | EX.2 | EX.3 | EX.4 | EX.5 | EX.6 | |
| 1-BIT COUNTER 1 | 0 | 1 | 1 | 1 | 1 | 0 | 0 | 0 | 1 | 1 | 0 | 1 | |
| 2 | 0 | 1 | 0 | 0 | 1 | 1 | 0 | 0 | 0 | 0 | 0 | 0 | |
| 3 | 0 | 1 | 0 | 0 | 1 | 1 | 0 | 0 | 0 | 0 | 0 | 0 | |
| 4 | 0 | 1 | 1 | 1 | 1 | 0 | 0 | 0 | 1 | 1 | 0 | 1 | |
| 5 | 0 | 1 | 1 | 1 | 1 | 0 | 0 | 0 | 1 | 1 | 0 | 1 | |
| ⋮ | | | | ⋮ | | | | | | ⋮ | | | |
| 19 | 0 | 1 | 1 | 1 | 1 | 0 | 0 | 0 | 1 | 1 | 0 | 1 | |
| 20 | 1 | 0 | 1 | 1 | 1 | 0 | 1 | 1 | 1 | 1 | 0 | 1 | |
| 21 | 0 | 1 | 1 | 1 | 1 | 0 | 0 | 0 | 1 | 1 | 0 | 1 | |
| 22 | 1 | 0 | 1 | 1 | 1 | 0 | 1 | 1 | 1 | 1 | 0 | 1 | |
| 23 | 1 | 0 | 1 | 1 | 1 | 0 | 1 | 1 | 1 | 1 | 0 | 1 | |
| ⋮ | | | | ⋮ | | | | | | ⋮ | | | |
| n−5 | 1 | 0 | 1 | 1 | 1 | 0 | 1 | 1 | 1 | 1 | 0 | 1 | |
| n−4 | 1 | 0 | 1 | 1 | 1 | 0 | 1 | 1 | 1 | 1 | 0 | 1 | |
| n−3 | 1 | 0 | 1 | 1 | 1 | 0 | 1 | 1 | 1 | 1 | 0 | 1 | |
| n−2 | 1 | 0 | 1 | 0 | 0 | 1 | 1 | 1 | 1 | 2 | 1 | 2 | |
| n−1 | 1 | 0 | 0 | 0 | 0 | 1 | 1 | 1 | 2 | 2 | 1 | 2 | |
| n | 1 | 0 | 1 | 1 | 1 | 0 | 1 | 1 | 1 | 1 | 0 | 1 | |
| n+1 | 1 | 0 | 0 | 0 | 0 | 1 | | | | | | | |
| n+2 | 1 | 0 | 0 | 0 | 0 | 1 | | | | | | | |
| | | | | | | | − | ○ | − | − | ○ | ○ | +1 |
| | | | | | | | − | − | ○ | ○ | − | ○ | +2 |

TIME INTERVAL MEASUREMENT SYSTEM AND METHOD APPLIED THEREIN

BACKGROUND OF THE INVENTION

The present invention relates to a time interval measurement system and a time interval measurement method applied in the system, and in particular, to a system and method for measuring a time interval between signals inputted from the object of measurement utilizing logical circuits and the system clock of the circuits.

DESCRIPTION OF THE PRIOR ART

FIG. 1 is a block diagram showing an example of a conventional time interval measurement system. The system comprises an AND gate 121, D-type flip-flops 122 and 123, a m-bit counter 124, a register 125, and a MPU (Micro Processor Unit) 126. FIG. 2 is a timing chart showing operation of the conventional time interval measurement system.

In the following, the operation of the conventional time interval measurement system will be described with reference to FIG. 1 and FIG. 2. In FIG. 1, a START signal rising at a start point and a STOP signal falling at a stop point are inputted into the AND gate 121, and a logical product of two signals is obtained by the AND gate 121. The logical product output $\alpha$ (see FIG. 2) of the AND gate 121 is inputted into the D(Data)-terminal of the D-type flip-flop 122. Meanwhile, a system clock signal $\phi$ (see FIG. 2) is supplied to C(Clock)-terminals of each of the D-type flip-flops 122, 123 and the m-bit counter 124. The D-type flip-flops 122 and 123 compose a shift register controlled by the system clock signal $\phi$. A signal outputted from the shift register according to the logical product output $\alpha$ is inputted into an EN(ENable)-terminal of the m-bit counter 124. The m-bit counter 124 counts the number of pulses of the system clock signal $\phi$ while the EN(ENable)-terminal is enabled, and outputs the counted values of each bit into the register 125. Then, the sum $\Sigma$ of the values represented by each bit is obtained and sent to the MPU 126, and the MPU 126 calculates the time interval between the START signal and the STOP signal by multiplying the sum $\Sigma$ by the cycle time of the system clock signal $\phi$.

In the above conventional time interval measurement system, measurement accuracy is all dependent on the cycle time of the system clock signal $\phi$, which has a minimum limit restricted by manufacturing processes of semiconductors used for generating the system clock signal $\phi$. Even in the case where the system clock signal $\phi$ is obtained via a frequency multiplier or a ring oscillator to multiply the frequency of the system clock signal $\phi$, it is the same thing that the minimum cycle time is restricted by the manufacturing process of semiconductors therein, and the measurement accuracy is restricted by frequency limit of semiconductors concerned.

FIG. 3 is a block diagram showing another conventional time interval measurement system designed to improve the measurement accuracy. FIG. 4 is a timing chart showing the operation of the system. The system comprises an input circuit 135 for generating reset pulses R1, R2, R3 and R4 and latch timings CP1, CP2, CP3 and CP4 synchronized with rising edges of an input pulse signal IN supplied thereto to be measured, counters 136, 137, 138 and 139 each of which is reset by each of the reset pulses R1, R2, R3 and R4 respectively and counts up the number of pulses of a system clock signal $\phi$ commonly supplied to their C-terminals, latches 140, 141, 142 and 143 each of which latches each output of the counters 136, 137, 138 and 139 controlled with each of the latch timings CP1, CP2, CP3 and CP4 respectively, a reference number generator 144, a frequency value calculator 145, and a register 146.

In the following, the operation of the conventional time interval measurement system will be described with reference to FIG. 3 and FIG. 4. In FIG. 3, input pulse signal IN from the object of measurement is supplied to the input circuit 135, and the reset pulses R1, R2, R3 and R4 and latch timings CP1, CP2, CP3 and CP4 are generated according to the input pulse signal IN as shown in FIG. 4. Each of the latch timings CP1, CP2, CP3 and CP4 is generated at every fourth rising edge of the input pulse signal IN, and each of the reset pulses R1, R2, R3 and R4 is generated following just after each of the latch timings CP1, CP2, CP3 and CP4 respectively.

Each of the reset pulses R1, R2, R3 and R4 outputted from the input circuit 135 is inputted to each of the counters 136, 137, 138 and 139 respectively, and each of the latch timings CP1, CP2, CP3 and CP4 is inputted to each of the latches 140, 141, 142 and 143 respectively.

Common system clock signal CP is also supplied to each C(Clock)-terminal of the counters 136, 137, 138 and 139, and each of the counter 136, 137, 138 and 139 counts the number of pulses of the system clock signal CP between two consecutive reset pulses R1, R2, R3 and R4 respectively and sends the number to the latches 140, 141, 142 and 143 respectively.

Each of the latches 140, 141, 142 and 143 latches the output of the counters 136, 137, 138 and 139 indicating pulse number of the system clock signal CP in each period between every fourth rising edges of the input pulse signal IN, beginning by one cycle difference of the input pulse signal IN with each other as shown in FIG. 4.

Latched data in the latches 140, 141, 142 and 143 are read out by the frequency value calculator 145 for obtaining the sum of them. The sum is subsequently multiplied by the reference number generated by the reference number generator 144 for obtaining an average cycle time of the input pulse signal IN, and the average cycle time is registered in the register 146 as output data. In brief, the number of the pulses of the system clock signal CP is counted during four consecutive cycle time of the input pulse signal IN by four counters 136, 137, 138 and 139, and averaging is executed by dividing the sum of the counted numbers by four in order to obtain the cycle time of the input pulse signal IN.

In the above second conventional time interval measurement system, average value of four intervals is calculated in order to improve the measurement accuracy. When n time intervals have the same time widths, the measurement accuracy can be improved by n times, that is a difference of 1/n can be discriminated, by counting and taking an average of pulse numbers of the system clock arising asynchronously in the time intervals.

However, this average calculation method for improving measurement accuracy can not be applied for measuring an individual time interval or irregular time intervals. Furthermore, as for counters used for counting pulse numbers in the prior art of FIG. 1 and FIG. 3, there is a problem of input racing, that is, when a clock pulse is delivered racing with a beginning or an ending of a time interval, it is undetermined whether the clock pulse is counted or omitted. For the reason, a shift register composed of two D-type flip-flops 122 and 123 is provided in the prior art of FIG. 1. However, also as for the D-type flip-flop 122, there may occur the input racing when two input signals $\alpha$ and $\phi$ race critically with each other. Therefore, counted numbers may be uncertain by ±1.

FIG. 5 is a block diagram of a time interval measurement system which is presently proposed by the present inventors in order to measure individual time interval with improved measurement accuracy and resolve the input racing problem. The system in FIG. 5 comprises a high speed counter section 47, an adder section 48, and a control section 49.

The high speed counter section 47 includes a high frequency pulse generator circuit 50, a m-bit counter unit 51 comprised of a predetermined number of (for example, $n_2$=4 or 8) m-bit counters adopted for counting an integer part of the time interval to be measured, a 2-bit counter unit 52 comprised of n sets of 2-bit counters adopted for counting a decimal part of the time interval to be measured, which is provided with an output correction circuit for executing +1 correction to counted values in the 2-bit counters if necessary, and a 1-bit counter unit 53 adopted for obtaining a resolution number $n_1$ which will be described later.

The adder section 48 includes a selector unit 54 for selecting input of the adder section 48, a m-bit flip-flop (DFF) 55 for latching data, an adder (ADD) 56 for executing addition, and flip-flops (DFFs) 57 and 58 for latching data. And the control section 49 includes a register 59 and a MPU (Micro Processor Unit) 60.

In this system, the high frequency pulse generator circuit 50 as shown in FIG. 6 is adopted in order to realize measurement of an independent time interval with higher measurement accuracy (time resolution) than the cycle time T of the system clock signal ϕ. In FIG. 6, the high frequency pulse generator circuit 50 includes a delay buffer unit 63 comprised of a cascade connection of $n_3$ sets of delay buffers, a shift register unit 64 comprised of $n_3$+1 sets of 2-bit shift registers, and an AND gate unit 65 comprised of $n_3$ sets of AND gates.

In the following, the operation of this system will be described with reference to FIG. 5 through FIG. 8B.

A START signal rising at a start point and a STOP signal falling at a stop point are inputted into the high frequency pulse generator circuit 50 of the high speed counter section 47. In the high frequency pulse generator circuit 50 of FIG. 6, each of the delay buffers in the delay buffer unit 63 has common unit delay timeΔ which is shorter enough than the cycle time T of the system clock signal ϕ (for example, Δ=ϕ/25). The delay buffer unit 63 generates n delayed pulse signals by delaying the STOP signal by Δ, 2Δ, 3Δ, . . . nΔ respectively, as shown in FIG. 7. The shift register unit 64 controlled by the system clock signal ϕ quantizes pulse timings of the n delayed pulse signals and the START signal. In the AND gate unit 65, logical products between the START signal outputted from the shift register unit 64 and each of the n delayed pulse signals outputted from the shift register unit 64 are obtained respectively, and each of the logical products is sent to EN(ENable)-terminal of corresponding m-bit counter in the m-bit counter unit 51 as an enable signal for the m-bit counter. Incidentally, in the case where the number of the m-bit counter in the m-bit counter unit 51 is 4, 4 enable signals are inputted into the m-bit counter unit 51. Then, each m-bit counter in the m-bit counter unit 51, whose C(Clock)-terminal is supplied with the system clock signal ϕ, is enabled by the enable signal sent from corresponding AND gate, that is, the m-bit counter counts the number of pulses of the system clock signal ϕ while corresponding enable signal is inputted into the EN(ENable)-terminal.

The $n_3$ sets of enable signals are also supplied to the 2-bit counter unit 52 and the 1-bit counter unit 53. In the same way as the m-bit counter in the m-bit counter unit 51, each 2-bit counter in the 2-bit counter unit 52, whose C(Clock)-terminal is supplied with the system clock signal ϕ, counts the number of pulses of the system clock signal ϕ while corresponding enable signal is inputted into its EN(ENable)-terminal. Similarly, each 1-bit counter in the 1-bit counter unit 53, whose C(Clock)-terminal is supplied with the system clock signal ϕ, counts the number of pulses of the system clock signal ϕ while corresponding enable signal is inputted into its EN(ENable)-terminal.

FIG. 7 is a timing chart showing the operation of the time interval measurement system of FIG. 5. As shown in FIG. 7, the enable signals EN1—ENn inputted into corresponding counters are all quantized by the system clock signal ϕ, and each counted value of the m-bit counter, the 2-bit counter, and the 1-bit counter is also quantized by the system clock signal ϕ. As mentioned above, when a clock pulse of the system clock signal ϕ is delivered to a C(Clock)-terminal of a shift register (D-type flip-flop) in the shift register unit 64 racing with a falling edge of a delayed STOP signal inputted into the D(Data)-terminal of the shift register, input racing occurs. The delayed stop signal STOP20 in FIG. 7 is inputted into a shift register racing with a clock pulse of the system clock signal ϕ. Therefore, the timing of the falling edge of the enable signal EN20 in FIG. 7 is uncertain by ±1×T, and thus counted values in the 20th m-bit counter, the 20th 2-bit counter, and the 20th 1-bit counter are uncertain by ±1. In this time interval measurement system, in order to avoid the incorrectness due to the limit of the cycle time T of the system clock signal ϕ and the input racing, averaging between a plurality of counted values in the 2-bit counters adopted for counting the decimal part of the time interval is executed as well as averaging between a plurality of counted values in the m-bit counters adopted for counting the integer part of the time interval. Incidentally, the term 'integer part' means an integer part of the averaged value of the counted numbers of the pulses of the system clock signal ϕ, and the term 'decimal part' means a decimal part of the averaged value of the counted numbers of the pulses of the system clock signal ϕ.

Here, it is to be noted that the unit delayΔ of the delay buffers in the delay buffer unit 63 may always vary according to circumstances as temperature, power supply voltage, etc. The number n, i.e. the number of the 2-bit counters for counting the decimal part is predetermined so that n×Δ may be at least greater than the cycle time T of the system clock signal ϕ at any circumstances. In other words, if $\Delta_{min}$ is the minimum possible value of Δ, n is predetermined so that $n\times\Delta_{min}$ is slightly larger than the cycle time T of the system clock signal ϕ. Therefore, even in the case where a resolution number $n_1$, which will be mentioned below, is for example 25 in a normal measurement circumstance, the number of the 2-bit counters n has to be predetermined approximately 80. The number of the m-bit counters for counting the integer part can be considerably smaller than n (for example, $n_2$=4 or 8). The number of the delay buffers and the number of the 1-bit counters are predetermined larger than n (for example, $n_3$=1.5n or 2n) in order to realize counting of the resolution number $n_1$, the number indicating the number of the unit delays Δ with which the cycle time T of the system clock signal ϕ is packed (i.e. $\Delta\times n_1$ is nearly equal to T) at the moment of measurement.

The 1-bit counter unit 53 is utilized for counting the resolution number $n_1$. The resolution number $n_1$ is obtained after an counting process which will be described later, by counting the number of 1-bit counters in the longest sequence of the same logic 1 or 0 (HIGH or LOW). In an addition process related to the decimal part, which will be described later, $n_1$ sets of the 2-bit counters will be used for the addition. By using $n_1$ sets of the 2-bit counters for the addition related to the decimal part and dividing the added value by $n_1$ (i.e. by taking an average between $n_1$ sets of 2-bit counters) and cutting an integer part of the averaged value, the decimal part of the time interval to be measured can be obtained. For example, in the case of FIG. 7, $n_1$ is approximately 25, and thus the first 2-bit counter through the 25th 2-bit counter are used for obtaining the decimal part of the time interval.

Incidentally, as shown in FIG. 7, possible counted values of the m-bit counters are Q and Q+1 (2C and 2D in FIG. 7), and ideally, possible counted values of the 2-bit counters are Q', Q'+1 and Q'+2 in the worst case (0 and 1 in FIG. 7). In other words, necessary range of counted values of the 2-bit counters for counting the decimal part is wider than that of m-bit counters, since the number of the 2-bit counters is set so that $n\times\Delta$ may be at least greater than the cycle time T of the system clock signal $\phi$. In this system, 2-bit counters (not 1-bit counters) are adopted to count the decimal part, in order to correctly count the value Q', Q'+1 and Q'+2 by four possible values (00), (01), (10) and (11) of the 2-bit counters and carry information, maintaining precision of the averaged value of the values of the counters.

FIG. 8A and 8B is a flow chart showing the operation of the time interval measurement system of FIG. 5. In step S1, data in components of the time interval measurement system are initialized and the system waits for input of the START signal. When the rising edge of the START signal from the object of measurement is inputted into the high frequency pulse generator circuit 50 of the high speed counter section 47 (step S2) and the enable signals are inputted to the m-bit counters, 2-bit counters, and 1-bit counters, the counters start counting the number of the pulses of the system clock signal $\phi$ (step S3). Subsequently, when the falling edge of the STOP signal from the object of measurement is inputted into the high frequency pulse generator circuit 50 (step S4), the $n_3$ sets of the delayed stop signals (with unit delay $\Delta$) are generated in the delay buffer unit 63, and the enable signals are switched off one by one as shown in FIG. 7. Then, the m-bit counter, the 2-bit counter, and the 1-bit counter, corresponding to the off-switching of the enable signal stop counting the number of the pulses of the system clock signal $\phi$ (step S5). After all of the counters stopped counting one by one, counted values are held in the counters.

After finishing the above counting process, addition of values in counters is executed. First, addition of values in m-bit counters for integer part is executed. In step S6, the MPU 60 in the control section 49 sends a selection signal to the selector unit 54 in the adder section 48, and the values in the m-bit counter unit 51 are selected by the selector unit 54 in order to execute addition of the values of m-bit counters, then addition related to the integer part is started in the adder section 48. In the adder section 48, each m-bit counter is selected one by one by the selector unit 54, and the counted value in each m-bit counter is latched one by one in the m-bit DFF 55 to be supplied to the ADD 56. In the ADD 56, previous value in the ADD 56 and the supplied value are added together on every input of the supplied value synchronized with the system clock signal $\phi$, and eventually, the sum $\Sigma_1$ of the values in $n_2$ sets of the m-bit counters is obtained (step S7). The sum $\Sigma_1$ is sent to the register 59 and inputted to the MPU 60. Then, averaged value $H_1=\Sigma_1/n_2$ is obtained by the MPU 60 (step S8), and the integer part $h_1$ is obtained by cutting a decimal part of $H_1$ off by the MPU 60 (step S9). The integer part value $h_1$ is held in the MPU 60 for later use (step S10).

Along with the addition related to the integer part, the resolution number $n_1$, i.e. the number of the 2-bit counters to be used or added in addition related to the decimal part, is obtained by the MPU 60. The $n_1$ is obtained by counting the number of 1-bit counters in the longest sequence of the same logic 1 or 0 (HIGH or LOW) (step S11).

In step S12, the +1 correction is executed by the output correction circuit in the 2-bit counter unit 52. The output correction circuit executes the +1 correction to the counted values in the 2-bit counters when data in consecutive 2-bit counters involve a carry, i.e. when data in consecutive 2-bit counters are (11), (11), (11), (00), (00), . . . , for example. Whether or not the data in consecutive 2-bit counters involve a carry can be checked by confirming whether or not the least significant two digits of the integer part value $h_1$ are (11). If the least significant two digits of $h_1$ are (11), the MPU 60 instructs the output correction circuit to execute the +1 correction.

Incidentally, in the case where the number of the m-bit counters $n_2$ is a power of 2 such as 4, 'dividing a binary data by 4' is equivalent to 'shifting the data right by 2 bit' such as (101010)→(10101) (42/2=21 in decimal digits), and in the case where $n_2$ is 4, 'whether or not the least significant two digits of the integer part value $h_1$ are (11)' is equivalent to 'whether or not the third and the fourth digits of the sum $\Sigma_1$, outputted from the flip-flop 58 are (11)'. Therefore, above instruction from the MPU 60 to the output correction circuit is, in fact, not necessary. As shown in FIG. 5, the sum $\Sigma_1$ can be sent directly to the output correction circuit too, and the output correction circuit can automatically determine whether the +1 correction is necessary or not by checking the third and the fourth digits of the sum $\Sigma_1$. This method is more advantageous for high speed processing.

When the integer part value $h_1$ is, for example, ( . . . 11) and data in consecutive 2-bit counters are (11), (11), (11), (00), (00), . . . (i.e. 3, 3, 3, 0(4), 0(4) . . . in decimal digits), the output correction circuit executes the +1 correction correcting data in consecutive 2-bit counters to (00), (00), (00), (01), (01), . . . (i.e. 0, 0, 0, 1, 1 . . . in decimal digits) and send the corrected data to the adder section 48 in the following addition process related to the decimal part of the time interval to be measured.

After the integer part is obtained, addition of values of 2-bit counters for decimal part is executed. In step S13, the MPU 60 sends a selection signal to the selector unit 54, and the values from the 2-bit counter unit 52 are selected by the selector unit 54 in order to execute addition of the values of 2-bit counters, then addition related to the decimal part is started in the adder section 48. In the adder section 48, addition related to the decimal part is executed similarly to the aforementioned addition related to the integer part and the sum $\Sigma_2$ of the (corrected or not corrected) values from $n_1$ sets of the 2-bit counters is obtained (step S14). The sum $\Sigma_2$ is sent to the register 59 and inputted to the MPU 60. Then, averaged value $H_2=\Sigma_2/n_1$ is obtained by the MPU 60 (step S15), and the decimal part $h_2$ is obtained by cutting an integer part of $H_2$ off by the MPU 60 (step S16). The decimal part value $h_2$ is held in the MPU 60 for later use (step S17). Subsequently, the sum H of the integer part value $h_1$ and the decimal part value $h_2$ is obtained by the MPU 60 (step S18), and the time interval between the START signal and the STOP signal is obtained by multiplying the sum H by T (Here, T is the cycle time of the system clock signal $\phi$) (step S19).

As described above, according to the time interval measurement system described above which is presently proposed by the present inventors, measurement of individual time interval with remarkably improved measurement accuracy (for example, time resolution<T/25) is made possible.

However, in the above time interval measurement system, in order to duplicate the measurement accuracy, i.e. in order to make the time resolution ½, circuit scale of the system is necessitated to be twice as large as the system having original measurement accuracy. More concretely, in the system of FIG. 5, in which 2-bit counters are used for counting the decimal part to realize time interval measurement with smaller time resolution than the cycle time T of the system clock signal $\phi$, when the measurement accuracy is duplicated, i.e. when the time resolution is made ½, the numbers of the delay buffers, shift registers and AND gates are necessitated to be duplicated. Therefore, circuit scale of the high frequency pulse generator circuit 50 is necessitated to be duplicated in order to make the time resolution ½. Similarly, the number of the 2-bit counters in the 2-bit counter unit 52 is necessitated to be duplicated. Further, the number of bits needed in the components of the adder section 48 is necessitated to be increased since the sum of counted values of the 2-bit counters is duplicated, therefore circuit scale of the adder section 48 is necessitated to be duplicated.

As mentioned above, the above time interval measurement system presently proposed by the present inventors needs duplicated circuit scale in order to duplicate the measurement accuracy.

SUMMARY OF THE INVENTION

It is therefore the primary object of the present invention to provide a time interval measurement system and a time interval measurement method by which measurement of individual time interval with remarkably improved measurement accuracy is made possible with smaller circuit scale.

In accordance with the present invention, there is provided a time interval measurement system comprising a high speed counter section, an adder section, and a control section. The high speed counter section includes a m-bit counter unit having a plurality of m-bit counters, a first 1-bit counter unit having a plurality of first 1-bit counters, and a high frequency pulse generator circuit. The m-bit counters are used for counting the number of pulses of a clock signal for obtaining an integer part of a time interval between a START signal and a STOP signal inputted to the high speed counter section. The first 1-bit counters are used for counting the number of pulses of the clock signal for obtaining an decimal part of the time interval. The high frequency pulse generator circuit periodically generates a plurality of delayed signals at intervals of a unit delay time which is shorter than the cycle time of the clock signal, according to the input of the START signal to the high speed counter section, and supplies each of a plurality of counter stop signals according to the delayed signals to a corresponding m-bit counter in the m-bit counter unit and a corresponding first 1-bit counter in the first 1-bit counter unit.

The adder section executes addition of counted values of the m-bit counters in the m-bit counter unit and addition of counted values of the first 1-bit counters in the first 1-bit counter unit. The control section controls the time interval measurement system, obtains the integer part of the time interval by cutting off a decimal part of the average of the counted values of the m-bit counters using an output of the adder section, obtains the decimal part of the time interval by cutting off an integer part of the average of the counted values of the first 1-bit counters using an output of the adder section, and obtains the time interval by adding the integer part of the time interval and the decimal part of the time interval together and multiplying the added value by the cycle time of the clock signal.

In order to use the first 1-bit counters (not 2-bit counters) for obtaining the decimal part of the time interval, the first 1-bit counter unit is provided with a first correction circuit and a second correction circuit. The first correction circuit executes +1 correction to the counted values of the first 1-bit counters according to detection of involvement with a carry of a sequence of the counted values of the first 1-bit counters. The second correction circuit executes +2 correction to the counted values of the first 1-bit counters according to detection of involvement with return to an initial value of the sequence of the counted values of the first 1-bit counters.

Preferably, time interval measurement system further comprises a second 1-bit counter unit having a plurality of second 1-bit counters for counting the number of pulses of the clock signal for obtaining a resolution number $n_1$ of the high frequency pulse generator circuit at the moment of measurement. Each of the second 1-bit counters are supplied with a corresponding counter stop signal from the high frequency pulse generator circuit. The resolution number $n_1$ is obtained by counting the number of second 1-bit counters in the longest sequence of the same counted value 1 or 0, and the addition of the counted values of the first 1-bit counters by the adder section is executed to first 1-bit counters corresponding to $n_1$ pieces of earlier counter stop signals.

Preferably, the high frequency pulse generator circuit includes a delay buffer unit composed of a cascade connection of a plurality of delay buffers for delaying the STOP signal inputted to the high speed counter section by the unit delay time, a shift register unit having a plurality of shift registers to which outputs of the delay buffers are inputted respectively, a logic gate unit having a plurality of logic gates for executing logic operation between each of the outputs of the shift registers and a signal related to the START signal and outputting the result.

Preferably, the delay buffer is composed of two NOT gates connected in series.

Preferably, the NOT gate is composed of ECL transistors.

Preferably, the adder section comprises a selector unit for selecting either the m-bit counter unit or the first 1-bit counter unit for input, selecting one of the counters in the selected counter unit one by one, and inputting a value corresponding to the selected counter into the adder section one by one, and an adder for adding the values inputted by the selector unit together.

Preferably, the adder is an incremental-type adder including a first latch for latching output of the selector unit, an adder element whose one input terminal is supplied with data which has been latched by the first latch, and a second latch for latching output of the adder element and supplying its output to another input terminal of the adder element.

Preferably, the first correction circuit is composed of a plurality of EXOR gates whose one input terminal is supplied with a counted value of corresponding first 1-bit counter and whose another input terminal is supplied with a signal instructing the first correction circuit to execute +1 correction.

Preferably, the second correction circuit executes +2 correction by detecting return from 1 to 0 of the sequence of the counted values of the first 1-bit counters passed through the first correction circuit and adding 2 to the 0 which have returned from 1.

Preferably, the number of the first 1-bit counters is predetermined so that the number is not less than the cycle time of the clock signal divided by the shortest value of the unit delay time which is dependent on measurement circumstances.

Preferably, the number of the m-bit counters is a power of 2 and not less than 4.

Preferably, the number of the m-bit counters is 4.

Preferably, the number of the first 1-bit counters is reduced by utilizing the least significant digit of the m-bit counters as values of corresponding first 1-bit counters.

Preferably, the number of the second 1-bit counters is reduced by utilizing the least significant digit of the m-bit counters or values of the first 1-bit counters as values of corresponding second 1-bit counters.

Preferably, components of the system is composed of ECL transistors.

Preferably, components of the system is composed of CMOS transistors.

In accordance with another aspect of the present invention, the time interval measurement system further comprises a START signal generator for generating the START signal which is synchronized with the clock signal, and a beam unit for emitting a beam according to input of the START signal, generating the STOP signal according to reception of the beam reflected by an object, and sending the generated STOP signal to the high speed counter section, and the system is provided with functions for obtaining the distance between the beam unit and the object using obtained time interval.

Preferably, the beam unit is a laser beam unit emitting and receiving a laser beam.

Preferably, the system is installed in a car and utilized for measurement of the distance between cars.

Preferably, the m-bit counter of the system installed in a car and utilized for measurement of the distance between cars is a 6-bit counter or a 8-bit counter.

In accordance with another aspect of the present invention, there is provided a time interval measurement method for measuring a time interval between a START signal and a STOP signal, in which the time interval is obtained by counting the number of pulses of a clock signal using a plurality of m-bit counters for obtaining an integer part of the time interval and a plurality of 1-bit counters for obtaining a decimal part of the time interval. The method comprises 15 steps. In the first step, counting of the number of pulses of the clock signal is started by the m-bit counters and 1-bit counters according to input of the start signal. In the second step, a plurality of delayed signals are generated at intervals of a unit delay time which is shorter than the cycle time of the clock signal, according to the input of the START signal, and each of a plurality of counter stop signals according to the delayed signals is supplied to a corresponding m-bit counter and a corresponding first 1-bit counter on and on. In the third step, counting of the m-bit counters and 1-bit counters is stopped according to the counter stop signals on and on. In the fourth step, addition of counted values of the m-bit counters is started. In the fifth step, the addition is stopped at a predetermined number of times and an added value is obtained. In the sixth step, obtaining an average is obtained by dividing the added value by the predetermined number. In the seventh step, the integer part of the time interval is obtained by cutting a decimal part of the average off. In the eighth step, +1 correction is executed to the counted values of the 1-bit counters according to detection of involvement with a carry of a sequence of the counted values of the 1-bit counters. In the ninth step, +2 correction is executed to the counted values of the 1-bit counters according to detection of involvement with return to an initial value of the sequence of the counted values of the 1-bit counters. In the tenth step, addition of the corrected values from the 1-bit counters is started. In the eleventh step, the addition is stopped at a predetermined number of times and an added value is obtained. In the twelfth step, an average is obtained by dividing the added value by the predetermined number. In the thirteenth step, the decimal part of the time interval is obtained by cutting an integer part of the average off. In the fourteenth step, the sum of the integer part obtained in the seventh step and the decimal part obtained in the thirteenth step is obtained. And in the fifteenth step, the time interval is obtained by multiplying the sum by the cycle time of the clock signal.

Preferably, counting by a plurality of second 1-bit counters for obtaining a resolution number $n_1$ is further executed in the first step through the third step, and the resolution number $n_1$ is obtained by counting the number of the second 1-bit counters in the longest sequence of the same counted value, and the stopping of the addition in the eleventh step is executed at a number of times corresponding to $n_1$.

BRIEF DESCRIPTION OF THE DRAWINGS

The objects and features of the present invention will become more apparent from the consideration of the following detailed description taken in conjunction with the accompanying drawings, in which:

FIG. 16 is a table showing examples of corrections by the first correction circuit and the second correction circuit according to the present invention;

DESCRIPTION OF THE PREFERRED EMBODIMENTS

Figure 1:
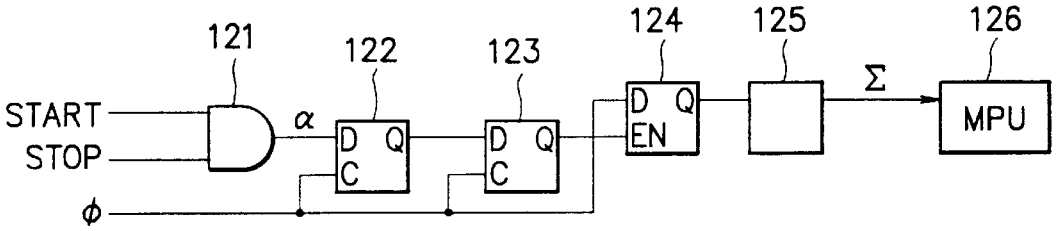
FIG. 1 PRIOR ART
FIG. 1 is a block diagram showing an example of a conventional time interval measurement system.
Figure 2:
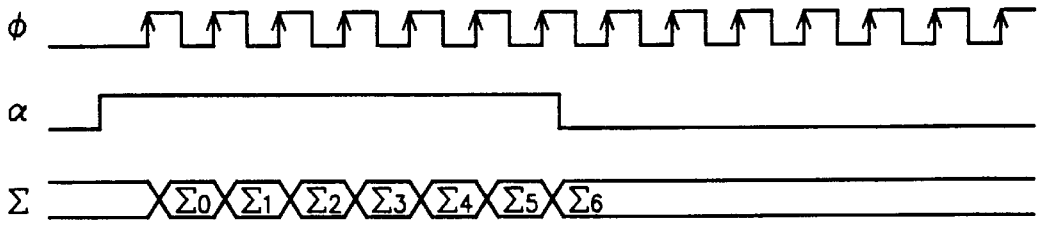
FIG. 2 PRIOR ART
FIG. 2 is a timing chart showing operation of the conventional system of FIG. 1.
Figure 3:
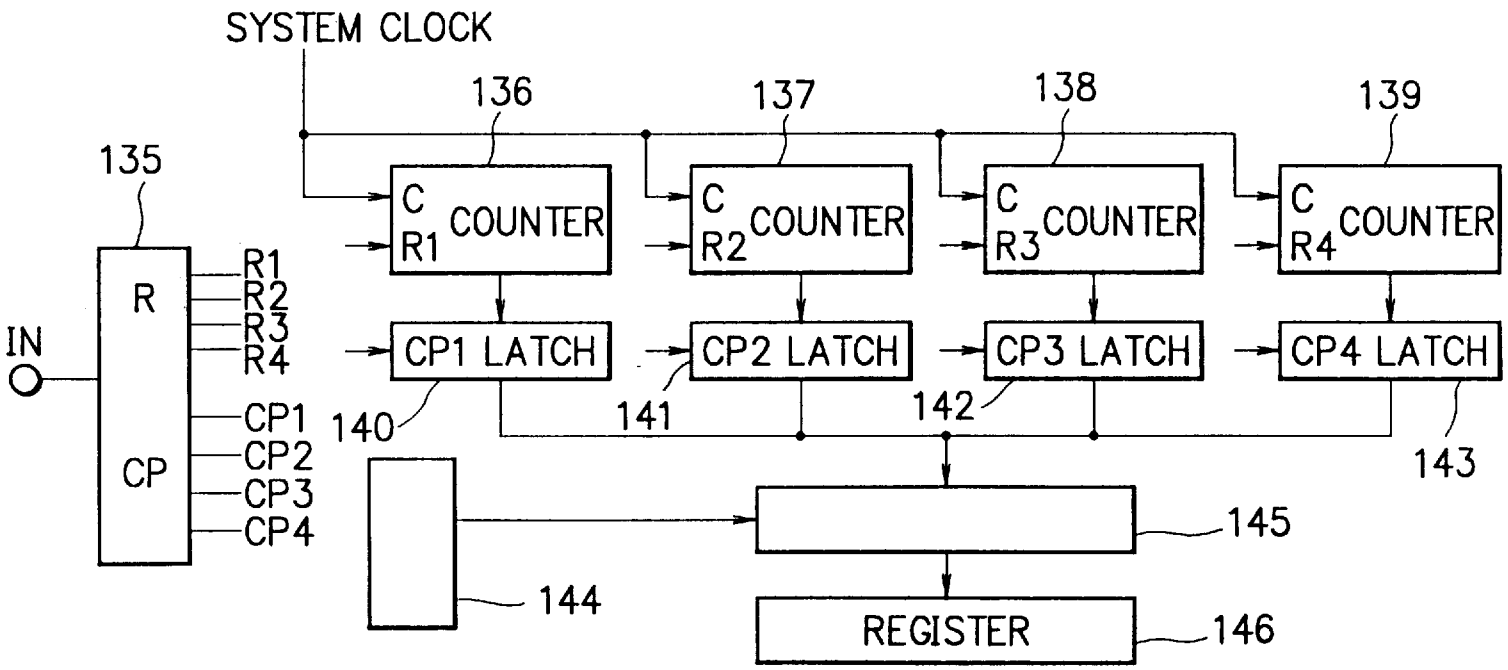
FIG. 3 PRIOR ART
FIG. 3 is a block diagram showing another conventional time interval measurement system designed to improve the measurement accuracy.
Figure 4:
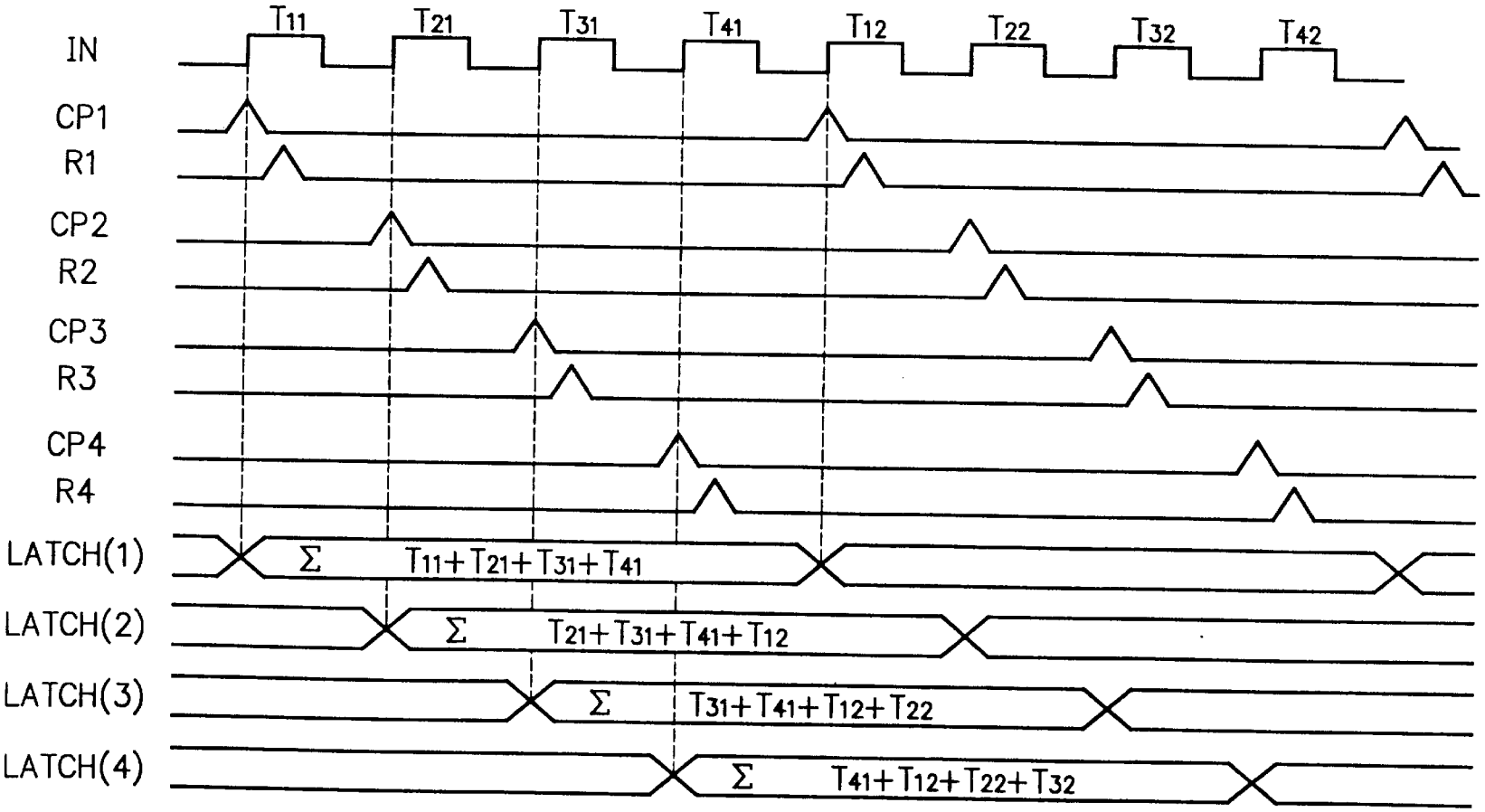
FIG. 4 PRIOR ART
FIG. 4 is a timing chart showing the operation of the conventional system of FIG. 3.

Referring now to the drawings, a description will be given in detail of a method and an apparatus in accordance with the present invention.

Figure 9:
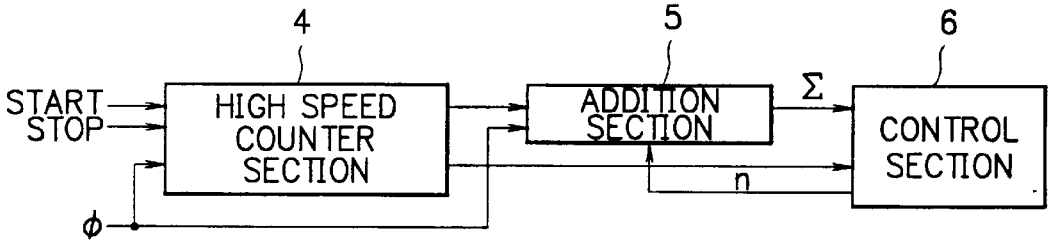
FIG. 9 is a schematic block diagram showing basic composition of a time interval measurement system according to the present invention.
Figure 10:
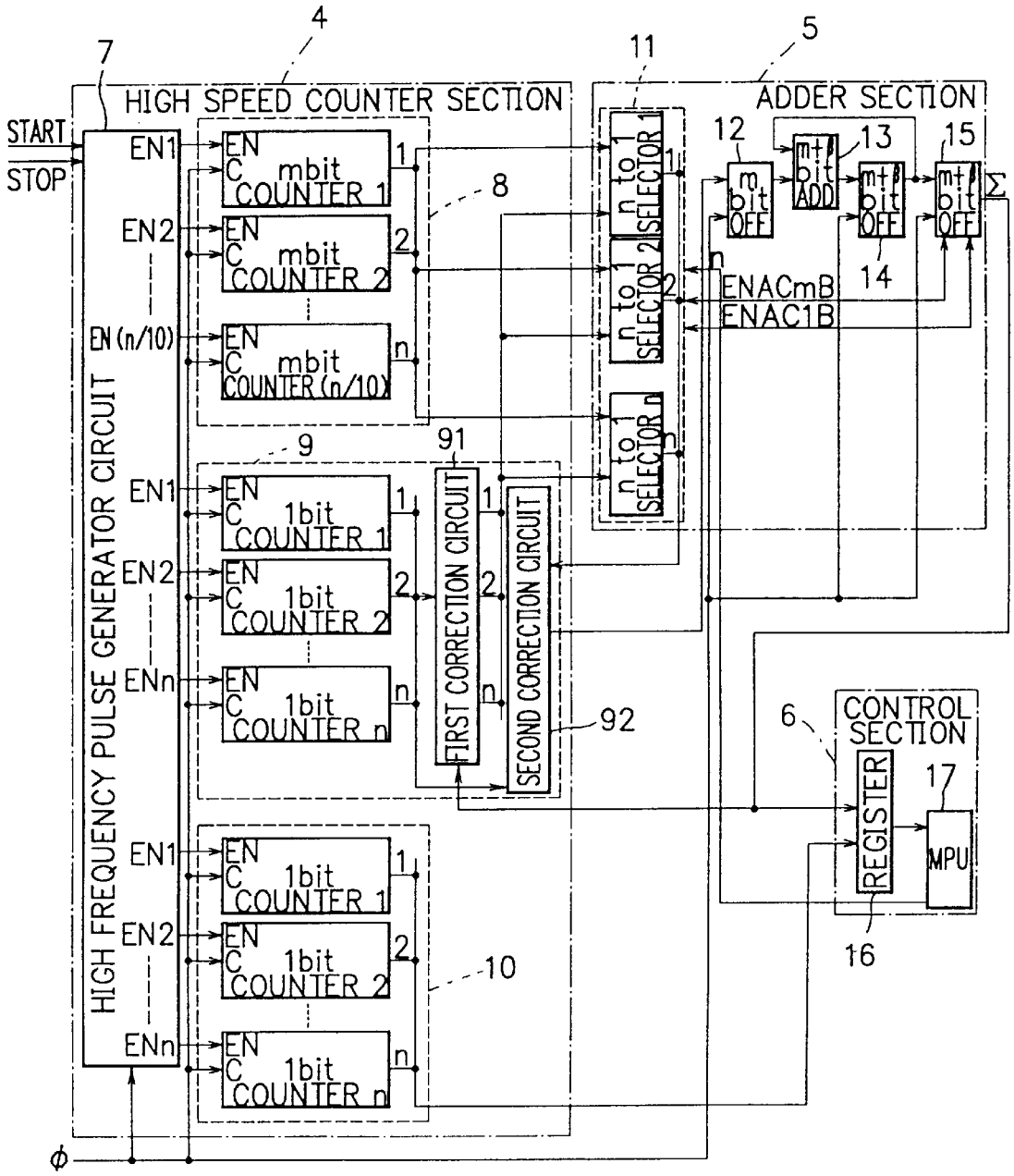
FIG. 10 is a block diagram of the time interval measurement system of FIG. 9.

FIG. 9 is a schematic block diagram showing basic composition of a time interval measurement system according to the present invention and FIG. 10 is a block diagram of the time interval measurement system of FIG. 9. The system comprises a high speed counter section 4, an adder section 5, and a control section 6.

The high speed counter section 4 includes a high frequency pulse generator circuit 7, a m-bit counter unit 8 comprised of a predetermined number of (for example, $n_2$32 4 or 8) m-bit counters adopted for counting an integer part of the time interval to be measured, a 1-bit counter unit 9 comprised of n sets of 1-bit counters adopted for counting a decimal part of the time interval to be measured, which is provided with a first correction circuit 91 for executing +1 correction and a second correction circuit 92 for executing +2 correction, and a 1-bit counter unit 10 adopted for obtaining a resolution number $n_1$.

The adder section 5 includes a selector unit 11 for selecting input of the adder section 5, a m-bit flip-flop (DFF) 12 for latching data, an adder (ADD) 13 for executing addition, and flip-flops (DFFs) 14 and 15 for latching data. The adder in the section 5 is composed of an incremental-type adder with small circuit scale. And the control section 6 includes a register 16 and a MPU (Micro Processor Unit) 17.

Figure 5:
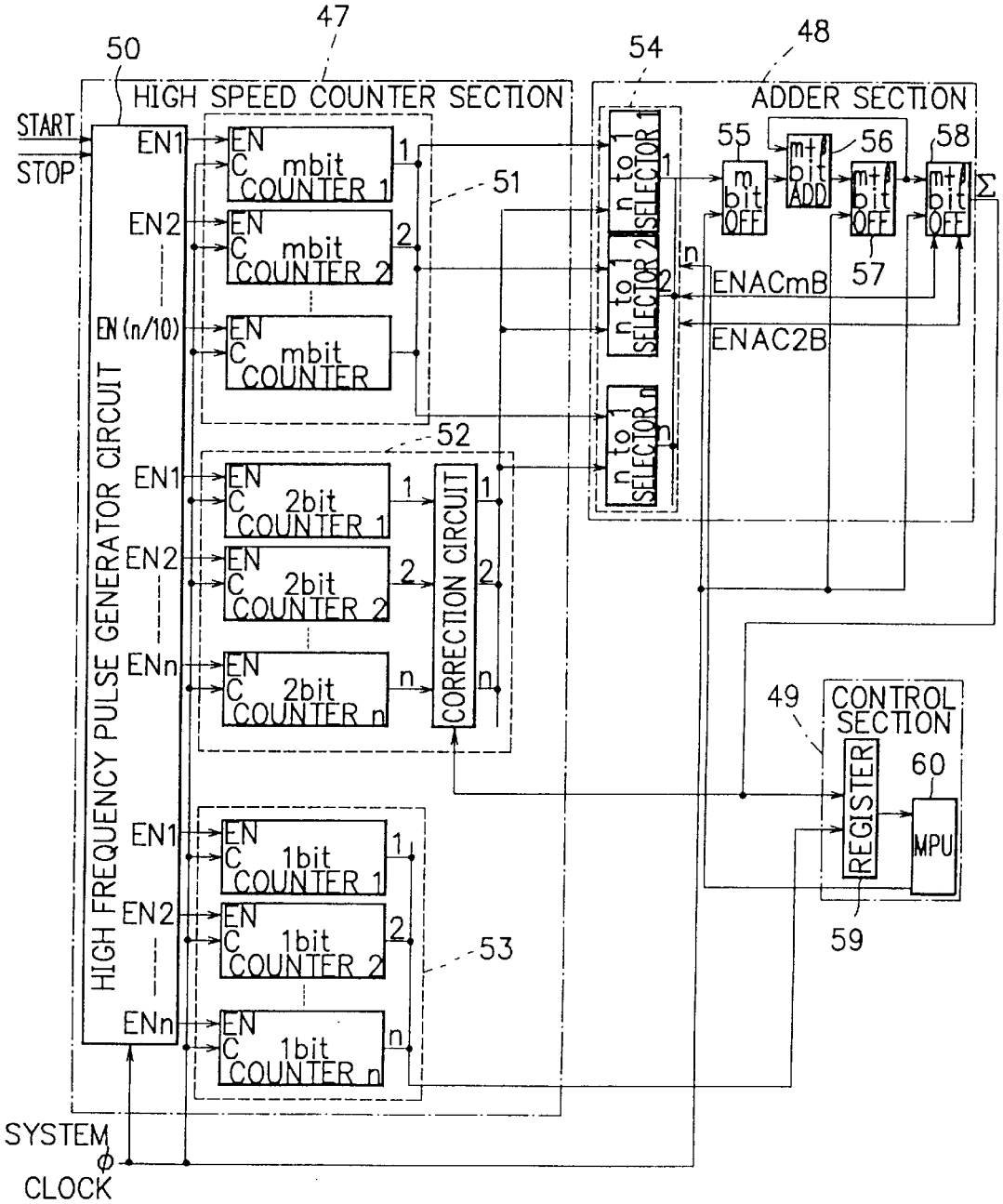
FIG. 5 is a block diagram of a time interval measurement system which is presently proposed by the present inventors.

As seen in FIG. 10, the time interval measurement system of FIG. 10 has similar composition to the system of FIG. 5. However, in the system of FIG. 10, 1-bit counter unit 9 is adopted for counting the decimal part of the time interval to be measured, and the second correction circuit 92 for executing +2 correction is added.

Figure 6:
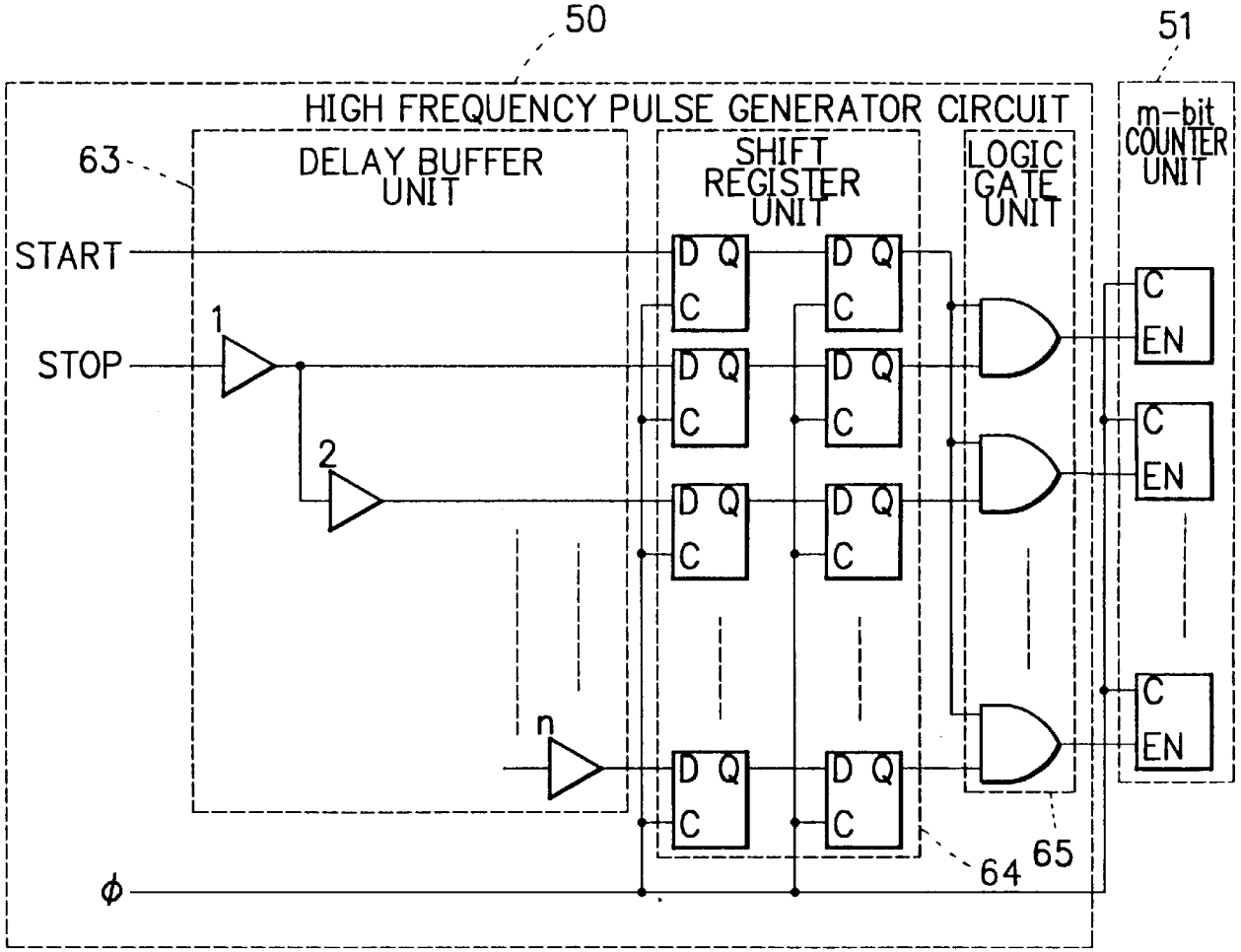
FIG. 6 is a block diagram showing composition of a high frequency pulse generator circuit in the system of FIG. 5.
Figure 7:
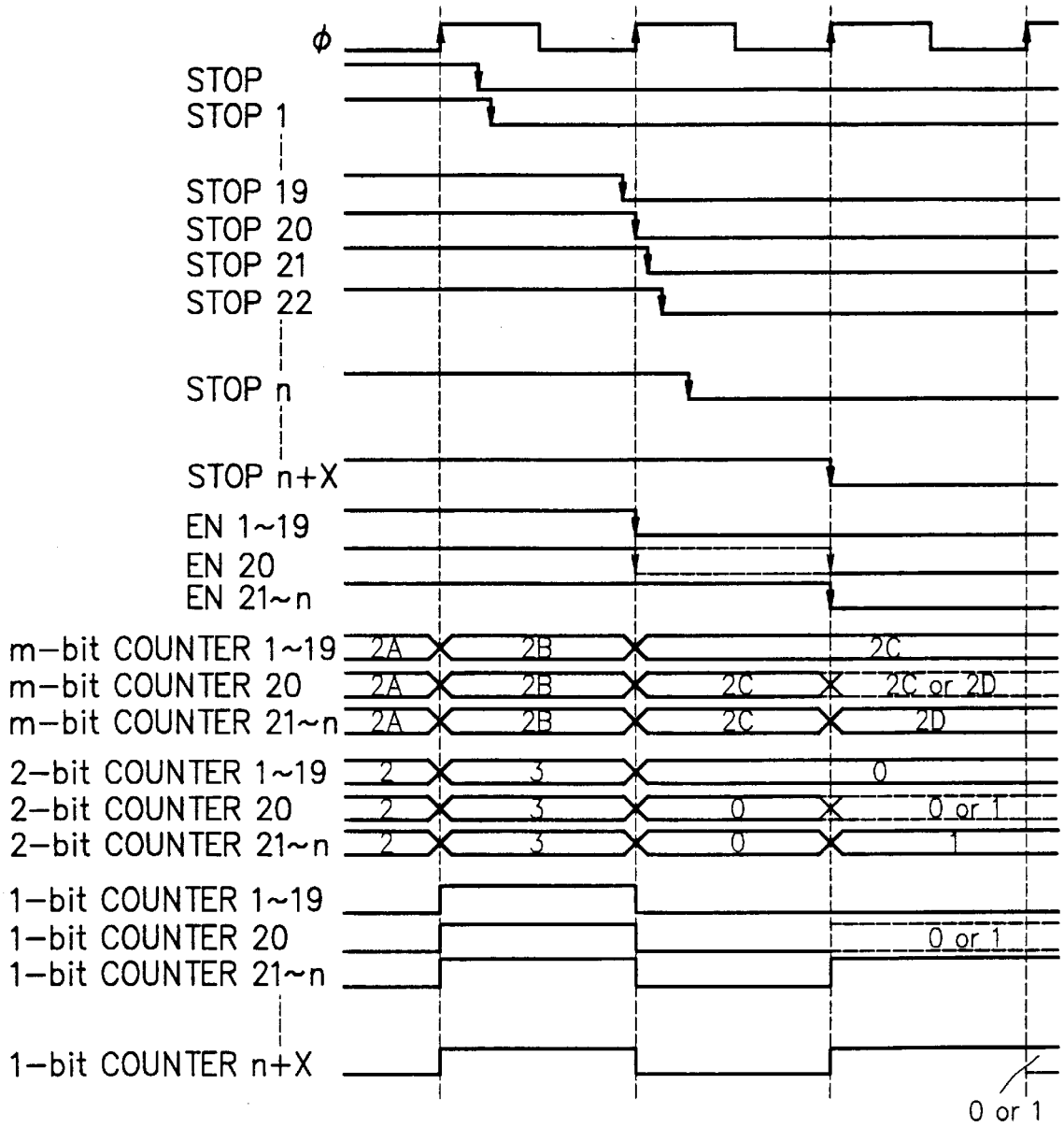
FIG. 7 is a timing chart showing the operation of the time interval measurement system of FIG. 5.
Figure 8A:
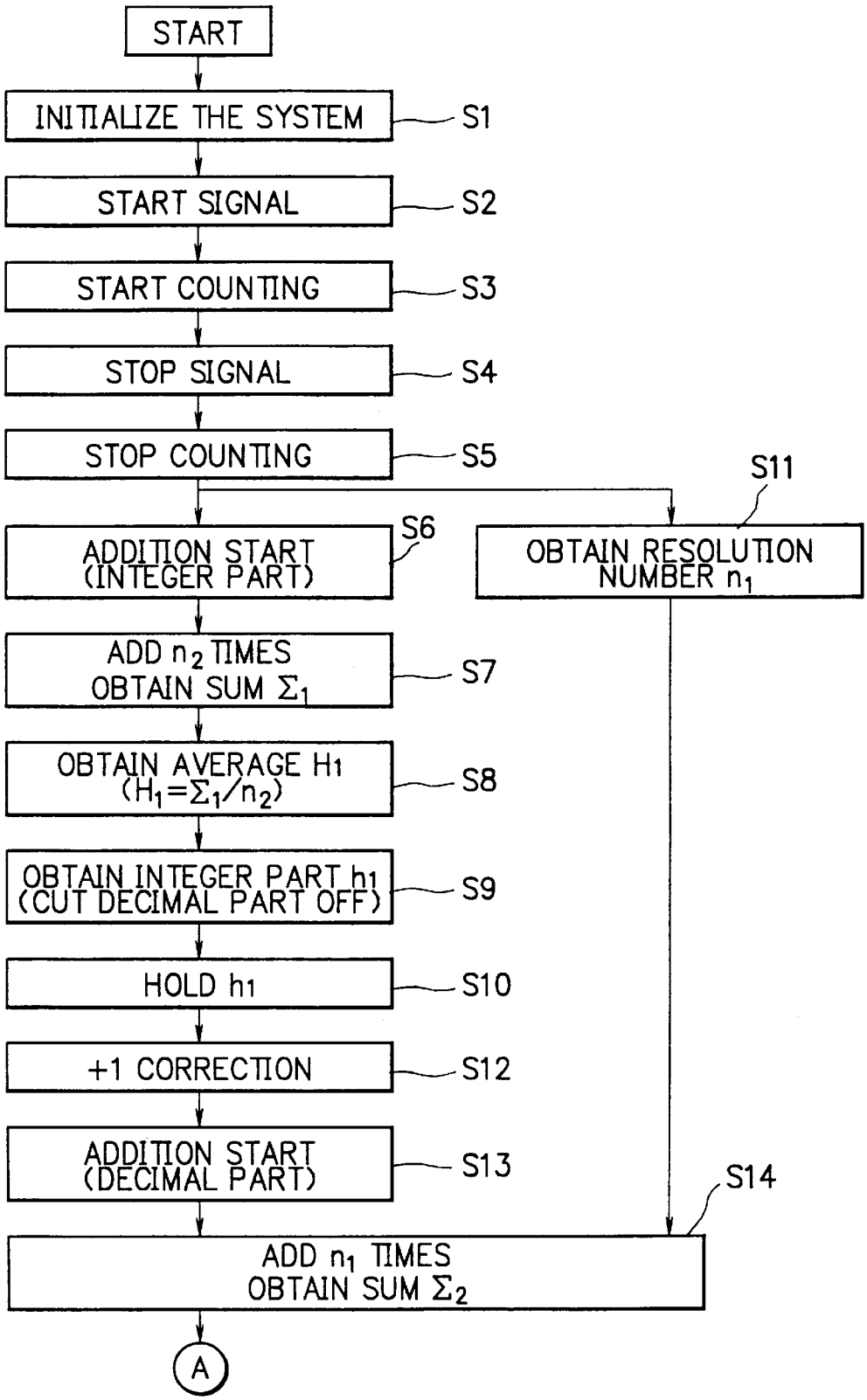
FIG. 8A and 8B is a flow chart showing the operation of the time interval measurement system of FIG. 5.
Figure 8B:
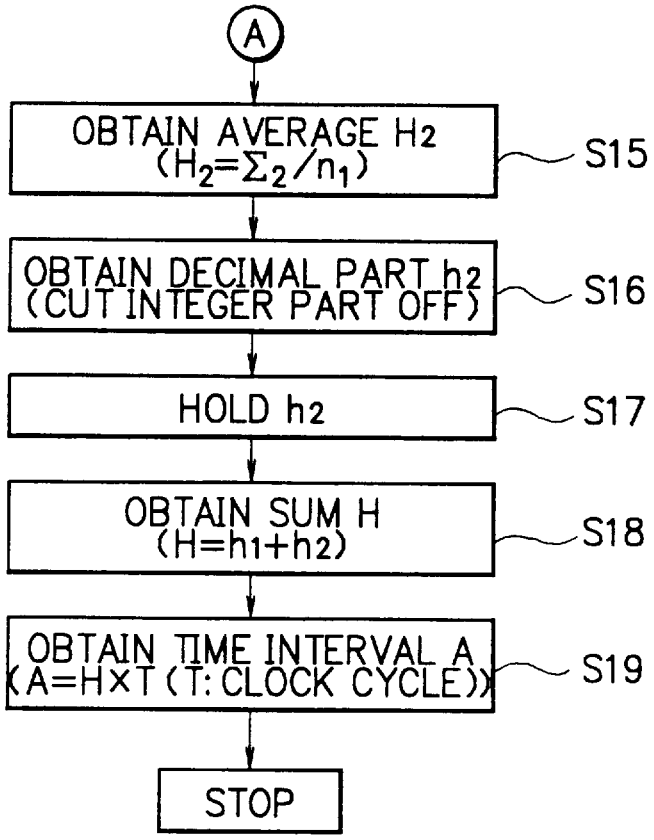
Figure 11:
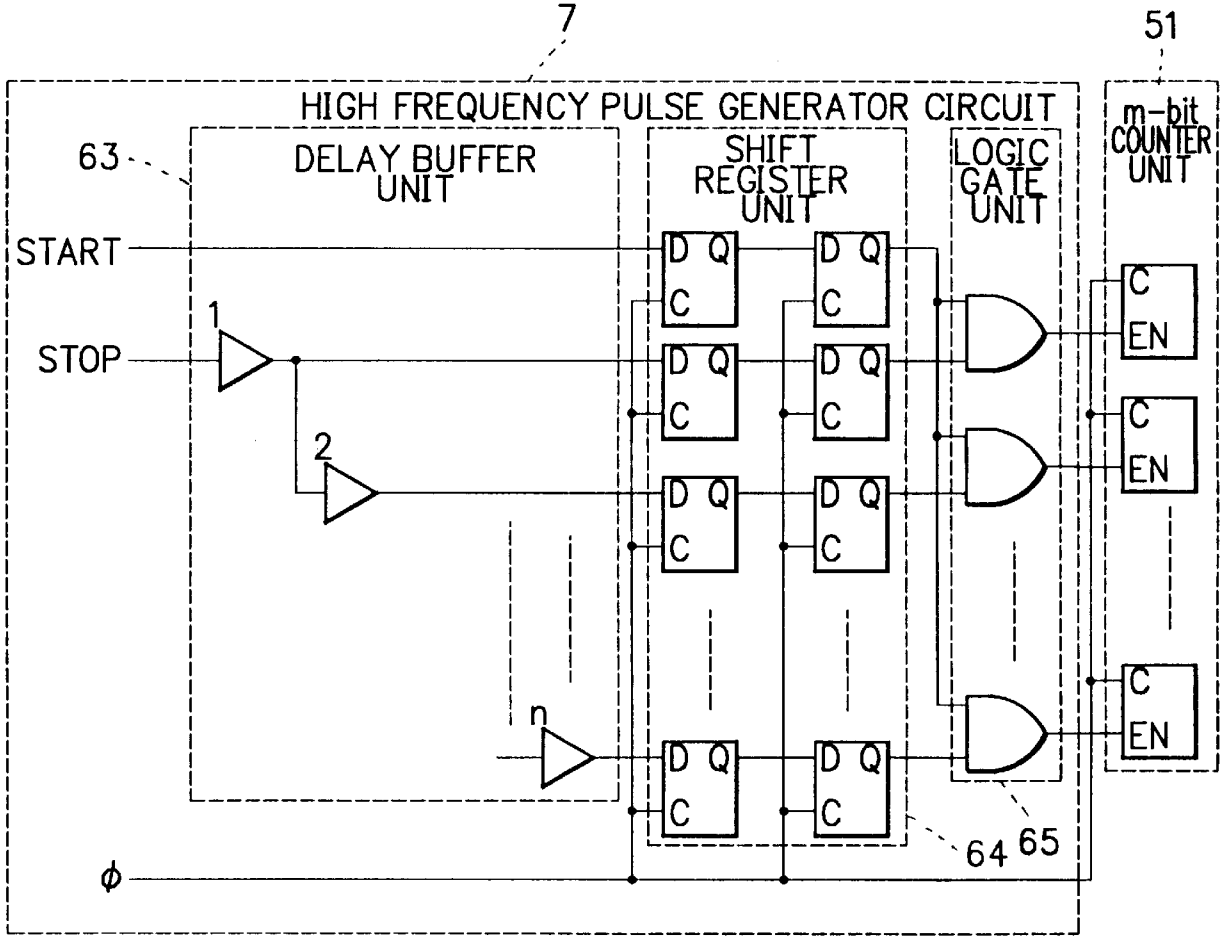
FIG. 11 is a block diagram showing composition of a high frequency pulse generator circuit in the system of FIG. 10.

FIG. 11 is a block diagram showing composition of the high frequency pulse generator circuit 7. The high frequency pulse generator circuit 7 is adopted in order to realize measurement of an independent time interval with remarkably high measurement accuracy (for example, time resolution<T/25, T: cycle time of the system clock signal $\phi$) In FIG. 11, the high frequency pulse generator circuit 7 includes a delay buffer unit 63 comprised of a cascade connection of $n_3$ sets of delay buffers, a shift register unit 64 comprised of $n_3$+1 sets of 2-bit shift registers, and an AND gate unit 65 comprised of $n_3$ sets of AND gates. The composition in FIG. 11 is the same as the composition in FIG. 6.

Figure 12:
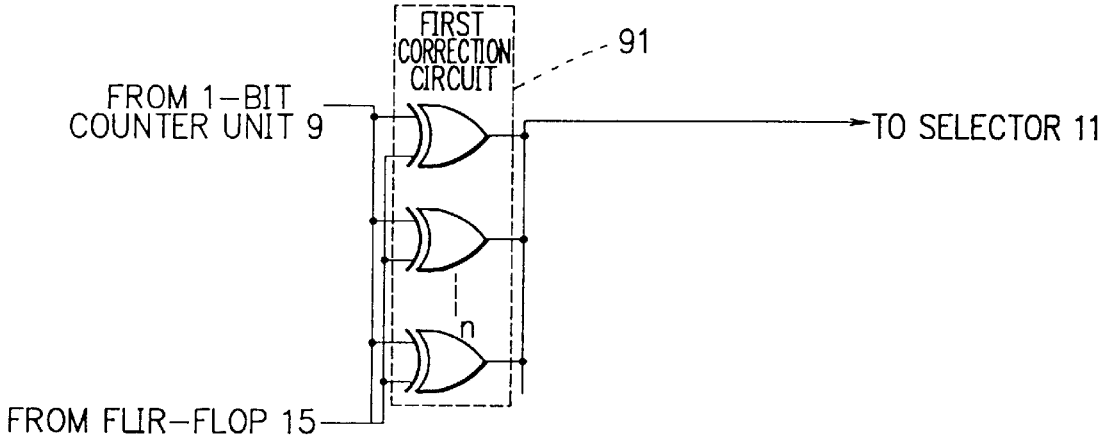
FIG. 12 is a block diagram showing an example of composition of a first correction circuit according to the present invention.
Figure 13:
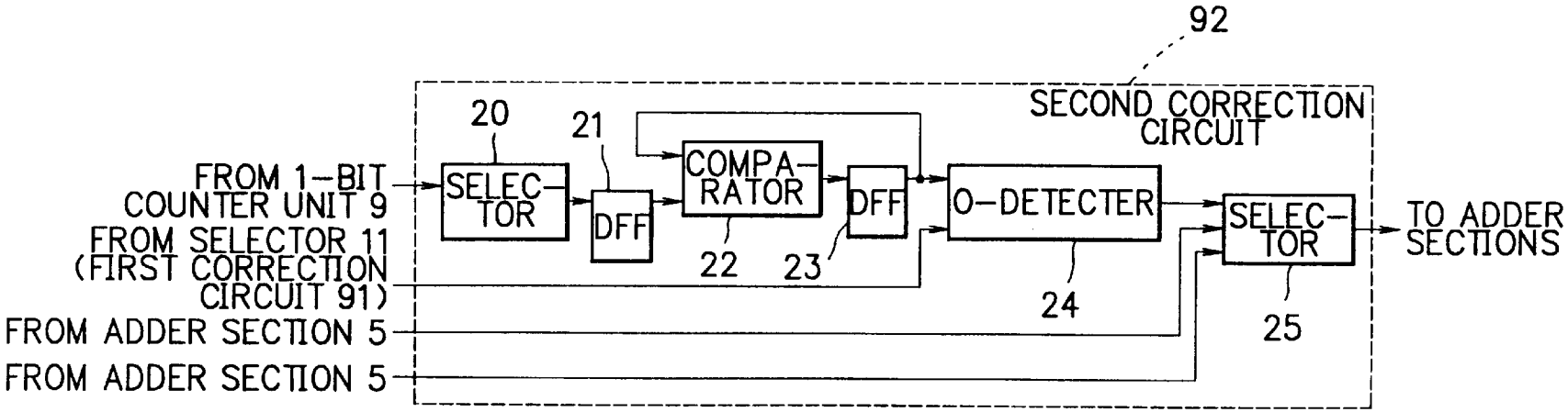
FIG. 13 is a block diagram showing an example of composition of a second correction circuit according to the present invention.

FIG. 12 and FIG. 13 are block diagrams showing examples of composition of the first correction circuit 91 and the second correction circuit 92 respectively. The first correction circuit 91 comprises n sets of logic gates such as EXOR gates. The second correction circuit 92 comprises a selector 20 for selecting necessary value in one of the 1-bit counters in the 1-bit counter unit 9, a DFF 21 for latching the output of the selector 20, a comparator 22 for comparing the output of the DFF 21 with an output of a DFF 23 to which output of the comparator 22 is inputted and detecting variation of the selected values from the 1-bit counters, the DFF 23 for latching the output value of the comparator 22 and returning the value to the comparator 22, and a 0-detector 24 for detecting 0-return of the values from the 1-bit counters which have passed through the first correction circuit 91 by comparing the value with the output of the DFF 23. Each of the comparator 22 and the 0-detector 24 can be composed of a EXNOR gate.

Circuit scale of the second correction circuit 92 can be approximately 100 gates and circuit scale of a 1-bit counter is approximately 10 gates (½ of a 2-bit counter), and thus in the case where the number of the 1-bit counters in the 1-bit counter unit 9 is approximately 80, by use of 1-bit counters for obtaining the decimal part according to the present invention, circuit scale of approximately 800 gates can be reduced and circuit scale of approximately 100 gates is further needed, in comparison with the case of FIG. 5 in which 2-bit counters are used for obtaining the decimal part. Therefore, circuit scale of the high speed counter section 4 using 1-bit counters is approximately 60% of the high speed counter section 47 in FIG. 5 using 2-bit counters.

In the following, the operation of the system of FIG. 10 will be described with reference to FIG. 10 through FIG. 16.

Figure 14:
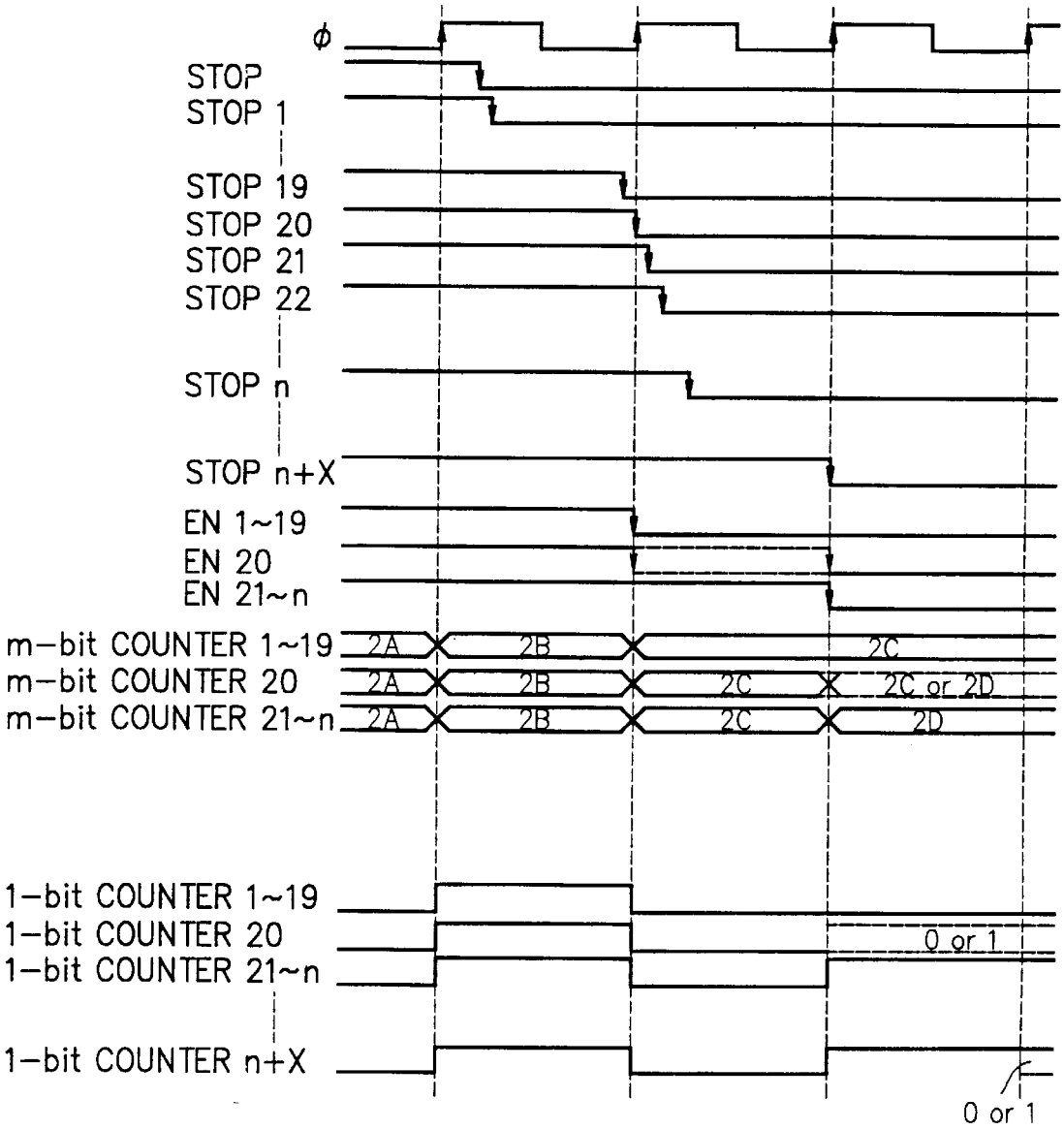
FIG. 14 is a timing chart showing the operation of the time interval measurement system of FIG. 10.

A START signal rising at a start point and a STOP signal falling at a stop point are inputted into the high frequency pulse generator circuit 7 of the high speed counter section 4. In the high frequency pulse generator circuit 7 of FIG. 11, each of the delay buffers in the delay buffer unit 63 has common unit delay time$\Delta$ which is shorter enough than the cycle time T of the system clock signal $\phi$ (for example, $\Delta=\phi/25$). The delay buffer unit 63 generates n delayed pulse signals by delaying the STOP signal by $\Delta$, $2\Delta$, $3\Delta$, . . . $n\Delta$ respectively, as shown in FIG. 14. The shift register unit 64 controlled by the system clock signal $\phi$ quantizes pulse timings of the n delayed pulse signals and the START signal. In the AND gate unit 65, logical products between the START signal outputted from the shift register unit 64 and each of the n delayed pulse signals outputted from the shift register unit 64 are obtained respectively, and each of the logical products is sent to EN(ENable)-terminal of corresponding m-bit counter in the m-bit counter unit 8 as an enable signal for the m-bit counter. Then, each m-bit counter in the m-bit counter unit 51, whose C(Clock)-terminal is supplied with the system clock signal $\phi$, is enabled by the enable signal sent from corresponding AND gate, and the m-bit counter counts the number of pulses of the system clock signal $\phi$ while corresponding enable signal is inputted into the EN(ENable)-terminal.

The enable signals are also supplied to the 1-bit counter unit 9 and the 1-bit counter unit 10. In the same way as the m-bit counter in the m-bit counter unit 8, each 1-bit counter in the 1-bit counter unit 9, whose C(Clock)-terminal is supplied with the system clock signal $\phi$, counts the number of pulses of the system clock signal $\phi$ while corresponding enable signal is inputted into its EN(ENable)-terminal. Similarly, each 1-bit counter in the 1-bit counter unit 10, whose C(Clock)-terminal is supplied with the system clock signal $\phi$, counts the number of pulses of the system clock signal $\phi$ while corresponding enable signal is inputted into its EN(ENable)-terminal.

FIG. 14 is a timing chart showing the operation of the time interval measurement system of FIG. 10. As shown in FIG.

14, the n sets of enable signals EN1–ENn inputted into corresponding counters are all quantized by the system clock signal $\phi$, and each counted value of the m-bit counter, the 1-bit counter in the 1-bit counter unit 9, and the 1-bit counter in the 1-bit counter unit 10 is also quantized by the system clock signal $\phi$. As mentioned above, when a clock pulse of the system clock signal $\phi$ is delivered to a C(Clock)-terminal of a shift register (D-type flip-flop) in the shift register unit 64 racing with a falling edge of a delayed STOP signal inputted into the D(Data)-terminal of the shift register, input racing occurs. The delayed stop signal STOP20 in FIG. 14 is inputted into a shift register racing with a clock pulse of the system clock signal $\phi$. Therefore, the timing of the falling edge of the enable signal EN20 in FIG. 14 is uncertain by $\pm 1 \times T$, and thus counted values in the 20th m-bit counter, the 20th 1-bit counter in the 1-bit counter unit 9, and the 20th 1-bit counter in the 1-bit counter unit 10 are uncertain by ±1.

In this time interval measurement system, in order to avoid the incorrectness due to the limit of the cycle time T of the system clock signal $\phi$ and the input racing, averaging between a plurality of counted values in the 1-bit counters in the 1-bit counter unit 9 adopted for counting the decimal part of the time interval is executed as well as averaging between a plurality of counted values in the m-bit counters adopted for counting the integer part of the time interval.

The unit delay $\Delta$ of the delay buffers in the delay buffer unit 63 may always vary according to circumstances as temperature, power supply voltage, etc. The number n, i.e. the number of the 1-bit counters in the 1-bit counter unit 9 for counting the decimal part is predetermined so that $n \times \Delta$ may be at least greater than the cycle time T of the system clock signal $\phi$ at any circumstances. In other words, if $\Delta_{min}$ is the minimum possible value of $\Delta$, n is predetermined so that $n \times \Delta_{min}$ is slightly larger than T. The number of the m-bit counters for counting the integer part can be considerably smaller than n, and the present inventors have found out that the number of the m-bit counters $n_2$ can be as small as 4 and 4 sets of m-bit counters are enough for obtaining the integer part. Incidentally, if $n_2$ is a power of 2, division by $n_2$ can be easily carried out by shifting bits, and advantageous for high speed processing. The number $n_3$ of the delay buffers and the number of the 1-bit counters in the 1-bit counter unit 10 are predetermined larger than n (for example, $n_3$=1.5n or 2n) in order to realize counting of the resolution number $n_1$, the number indicating the number of the unit delays $\Delta$ with which the cycle time T of the system clock signal $\phi$ is packed (i.e. $\Delta \times n_1$ is nearly equal to T) at the moment of measurement.

Incidentally, for minimizing circuit scale of the system, the number of the 1-bit counters in the 1-bit counter unit 9 can be reduced by $n_2$, by utilizing the least significant digit of $n_2$ sets of the m-bit counters as values of $n_2$ sets of 1-bit counters in the 1-bit counter unit 9 and removing the $n_2$ sets of the 1-bit counters. Similarly, the number of the 1-bit counters in the 1-bit counter unit 10 can also be reduced by n by utilizing values of 1-bit counters in the 1-bit counter unit 9 and the least significant digit of the m-bit counters.

The 1-bit counter unit 10 is utilized for counting the resolution number $n_1$. The resolution number $n_1$ is obtained by counting the number of 1-bit counters in the longest sequence of the same logic 1 or 0 (HIGH or LOW). In an addition process related to the decimal part, $n_1$ sets of the 1-bit counters in the 1-bit counter unit 9 will be used for the addition. By using $n_1$ sets of the 1-bit counters in the 1-bit counter unit 9 for the addition related to the decimal part and dividing the added value by $n_1$ (i.e. by taking an average between $n_1$ sets of 1-bit counters in the 1-bit counter unit 9) and cutting an integer part of the averaged value, the decimal part of the time interval to be measured can be obtained. For example, in the case of FIG. 14, $n_1$ is approximately 25, and thus the first 1-bit counter through the 25th 1-bit counter in the 1-bit counter unit 9 are used for obtaining the decimal part of the time interval.

As shown in FIG. 14, possible counted values of the m-bit counters are Q and Q+1 (2C and 2D in FIG. 14), and ideally, possible counted values of the 1-bit counters are Q', Q'+1 and Q'+2 in the worst case (0 and 1 (LOW and HIGH) in FIG. 14). In other words, necessary range of counted values of the 1-bit counters in the 1-bit counter unit 9 for counting the decimal part is wider than that of m-bit counters, since the number of the 1-bit counters is set so that $n \times \Delta$ may be at least greater than the cycle time T of the system clock signal $\phi$. However, the 1-bit counter can count (0) or (1) only. In this system, in order to correctly count the value Q', Q'+1 and Q'+2 by two possible values (0) and (1) of the 1-bit counters and carry information, the 1-bit counter unit 9 is provided with two correction circuits, the first correction circuit 91 for executing +1 correction and the second correction circuit 92 for executing +2 correction, as shown in FIG. 12 and FIG. 13.

As shown in FIG. 10, when addition of the counted values of the 1-bit counters in the 1-bit counter unit is carried out in order to obtain the decimal part of the time interval, counted values of the 1-bit counters in the 1-bit counter unit 9 are first inputted to the first correction circuit 91 for executing +1 correction, and each corrected (or not corrected) value is selected by the selector unit 11 in the adder section 5 one by one and the selected value is next sent to the second correction circuit 92 for executing +2 correction. And the value passed through the first correction circuit 91 and the second correction circuit 92 is used for addition in the adder section.

Figure 15A:
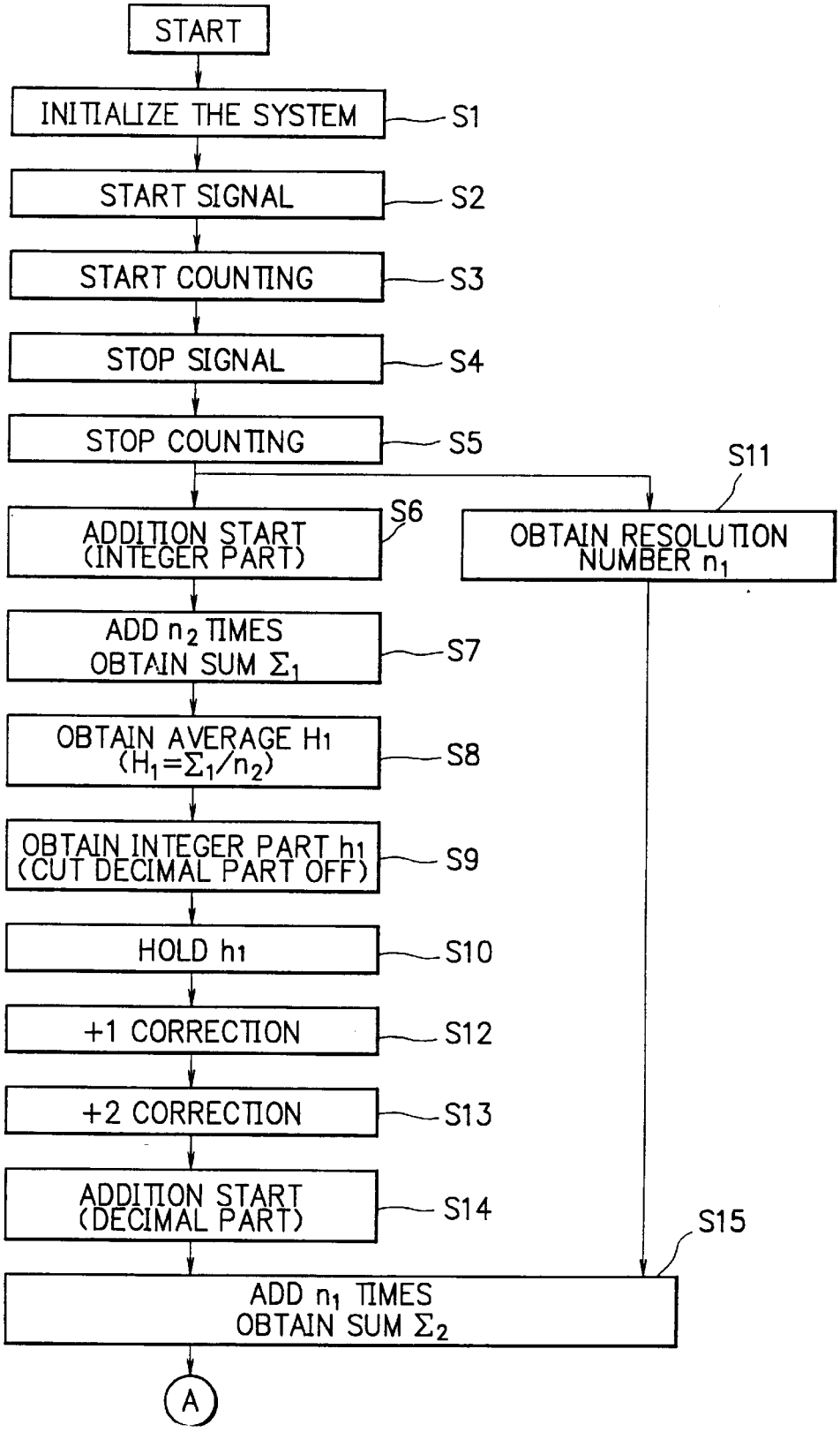
FIG. 15A and 15B is a flow chart showing the operation of the time interval measurement system of FIG. 10.
Figure 15B:
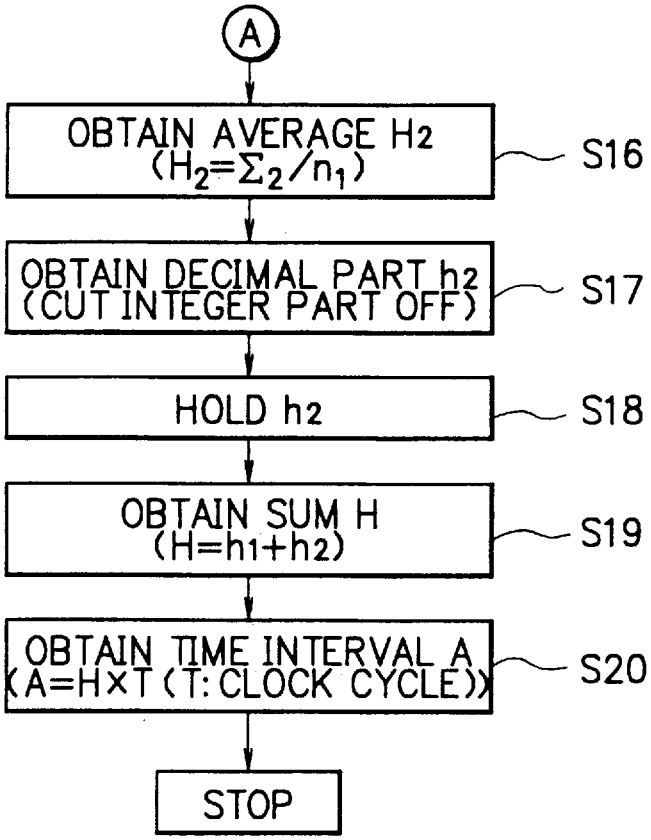

FIG. 15A and 15B is a flow chart showing the operation of the time interval measurement system of FIG. 10. In step S1, data in components of the time interval measurement system are initialized and the system waits for input of the START signal. When the rising edge of the START signal from the object of measurement is inputted into the high frequency pulse generator circuit 7 of the high speed counter section 4 (step S2) and the enable signals are inputted to the m-bit counters, 1-bit counters in the 1-bit counter unit 9, and 1-bit counters in the 1-bit counter unit 10, the counters start counting the number of the pulses of the system clock signal $\phi$ (step S3). Subsequently, when the falling edge of the STOP signal from the object of measurement is inputted into the high frequency pulse generator circuit 7 (step S4), the $n_3$ sets of the delayed stop signals (with unit delay $\Delta$) are generated in the delay buffer unit 63, and the enable signals are switched off one by one as shown in FIG. 14. Then, the m-bit counter, the 1-bit counter in the 1-bit counter unit 9, and the 1-bit counter in the 1-bit counter unit 10, corresponding to the off-switching of the enable signal stop counting the number of the pulses of the system clock signal $\phi$ (step S5). After all of the counters stopped counting one by one, counted values are held in the counters.

After the above counting process, addition is executed. First, addition of values in m-bit counters for integer part is executed. In step S6, the MPU 17 in the control section 6 sends a selection signal to the selector unit 11 in the adder section 5, and the values in the m-bit counter unit 8 are selected by the selector unit 11 in order to execute addition of the values of m-bit counters, then addition related to the integer part is started in the adder section 5. In the adder section 5, each m-bit counter is selected one by one by the selector unit 11, and the counted value in each m-bit counter is latched one by one in the m-bit DFF 12 to be supplied to the ADD 13. In the ADD 13, previous value in the ADD 13 and the supplied value are added together on every input of the supplied value synchronized with the system clock signal $\phi$, and eventually, the sum $\Sigma_1$ of the values in $n_2$ sets of the m-bit counters is obtained (step S7). The sum $\Sigma_1$ is sent to the register 16 and inputted to the MPU 17. Then, averaged value $H_1=\Sigma_1/n_2$ is obtained by the MPU 17 (step S8), and the integer part $h_1$ is obtained by cutting a decimal part of $H_1$ off by the MPU 17 (step S9). The integer part value $h_1$ is held in the MPU 17 for later use (step S10). Incidentally, as mentioned above, in the case where the number of the m-bit counters $n_2$ is 4 (a power of 2), dividing $\Sigma_1$ by $n_2$ can be easily carried out by ignoring the least significant two digits of the sum $\Sigma_1$. Therefore, in fact, above-mentioned division by $n_2$ and cutting off of decimal part of $H_1$ are not necessarily done by processing of the MPU 17.

Along with the addition related to the integer part, the resolution number $n_1$, i.e. the number of the 1-bit counters in the 1-bit counter unit 9 to be used or added in addition related to the decimal part, is obtained by the MPU 17. The $n_1$ is obtained by counting the number of 1-bit counters in the 1-bit counter unit 10, in the longest sequence of the same logic 1 or 0 (HIGH or LOW) (step S11).

In step S12, the +1 correction is executed by the first correction circuit 91 in the 1-bit counter unit 9. The output correction circuit executes the +1 correction to the counted values in the 1-bit counters when data in consecutive 1-bit counters in the 1-bit counter unit 9 involve a carry, i.e. when data in consecutive 1-bit counters are (1), (1), (1), (0), (0), . . . , for example. Whether or not the data in consecutive 1-bit counters involve a carry can be checked by confirming whether or not the least significant digit of the integer part value $h_1$ is (1). If the least significant digit of $h_1$ is (1), the MPU 17 instructs the output correction circuit to execute the +1 correction. As mentioned above, in the case where the number of the m-bit counters $n_2$ is 4 (a power of 2), 'whether or not the least significant digit of the $h_1$ is (1)' is equivalent to 'whether or not the third digit of the sum $\Sigma_1$ outputted from the flip-flop 15 is (1)'. Therefore, above instruction from the MPU 17 to the first correction circuit 91 is, in fact, not necessary. As shown in FIG. 10, the sum $\Sigma_1$, can be sent directly to the first correction circuit 91 too, and the first correction circuit 91 can automatically determine whether the +1 correction is necessary or not by checking the third digit of the sum $\Sigma_1$. This method is more advantageous for high speed processing.

When the integer part value $h_1$ is, for example, ( . . . 1) and data in consecutive 1-bit counters are (1), (1), (1), (0), (0) . . . (i.e. 1, 1, 1, 0(2), 0(2) . . . or 1(3), 1(3), 1(3), 0(4), 0(4) . . . in decimal digits), the first correction circuit 91 executes the +1 correction correcting data in consecutive 1-bit counters to (0), (0), (0), (1), (1), . . . (i.e. 0, 0, 0, 1, 1 . . . in decimal digits). As shown in FIG. 12, the first correction circuit 91 is comprised of EXOR gates, and into each EXOR gate, above-mentioned the third digit of the sum $\Sigma_1$ from the flip-flop 15 and a counted value of a corresponding 1-bit counter are inputted. If the third digit is (1), the EXOR gate inverts the counted value of the 1-bit counter, and if the third digit is (0), the EXOR gate directly outputs the counted value. In short, the +1 correction is executed by inverting the counted values of the 1-bit counters.

In step S13, the +2 correction is executed by the second correction circuit 92 in the 1-bit counter unit 9. First, by the second correction circuit 92 shown in FIG. 13, return to an initial value of a sequence of values of the consecutive 1-bit counters in the 1-bit counter unit 9 is detected. For example, in the case where the sequence of values of the 1-bit counters is {(0), . . . (1), . . . (0)}, this return to the initial value (0) means that two times of carries are involved in the sequence, that is, the latter (0) must be counted as (2). Therefore, the latter (0) is corrected by the second correction circuit 92 by adding 2. Unless such +2 correction, the sum and the average of the values of the 1-bit counters can not obtained correctly, and obtained decimal part becomes incorrect. Incidentally, the sequence of values from the 1-bit counters which has passed through the first correction circuit 91 generally starts from (0), since +1 correction has been executed to the sequence by the first correction circuit 91. Therefore, the second correction circuit 92 in FIG. 13 detects return from (1) to (0) of the sequence, and if the sequence involves return to (0), 2 is added to the latter (0). Concretely in FIG. 13, when the sequence returned to (0), a signal of a value of (1)(HIGH) is outputted by the 0-detector, and by the signal, (10)(2 in decimal digits) is added to the latter (0) from the 1-bit counter via the first correction circuit 91 which has been latched in the m-bit DFF 12, i.e. the second digit of the value latched in the m-bit DFF 12 is incremented.

FIG. 16 shows examples of corrections by the first correction circuit 91 and the second correction circuit 92 according to this embodiment. In FIG. 16, the least significant digit (LSD) of $h_1$ is 0 in EX.1, EX.3 and EX.4, and LSD of $h_1$ is 1 in EX.2, EX.5 and EX.6, and thus +1 correction is executed to EX.1, EX.3 and EX.4 and the values in the sequences are inverted by the first correction circuit 91. Incidentally, the value of the first 1-bit counter (the initial value of the sequence in FIG. 16) should ideally be the same value as the LSD of $h_1$. However, there exist cases where the two values are different, due to aforementioned input racing. Therefore, the initial value of the sequence is treated to be the same as the LSD of $h_1$ which is more reliable, and the initial value of the sequence after the +1 correction is treated to be (0) in any example. In each of EX. 3, EX.4 and EX.6, return to the initial value is involved in the sequence as marked with circles in FIG. 16, i.e. return to (0) is involved in the sequence after +1 correction, and thus +2 correction is executed to the returned values in the sequences of EX.3, EX.4 and EX.6 as marked with circles in FIG. 16.

Next, addition of values from 1-bit counters for decimal part is executed. In step S14, the MPU 17 sends a selection signal to the selector unit 11, and the values from the 1-bit counter unit 9 are selected by the selector unit 11 in order to execute addition of the values from 1-bit counters, then addition related to the decimal part is started in the adder section 5. In the addition, values from 1-bit counters via the first correction circuit 91 and the second correction circuit 92 are used. In the adder section 5, addition related to the decimal part is executed similarly to the aforementioned addition related to the integer part, and the sum $\Sigma_2$ of the (corrected or not corrected) values from $n_1$ sets of the 1-bit counters is obtained (step S15). The sum $\Sigma_2$ is sent to the register 16 and inputted to the MPU 17. Then, averaged value $H_2=\Sigma_2/n_1$ is obtained by the MPU 17 (step S16). and the decimal part $h_2$ is obtained by cutting an integer part of $H_2$ off by the MPU 17 (step S17). The decimal part value $h_2$ is held in the MPU 17 for later use (step S18). Subsequently, the sum H of the integer part value $h_1$ and the decimal part value $h_2$ is obtained by the MPU 17 (step S19), and the time interval between the START signal and the STOP signal is obtained by multiplying the sum H by the cycle time T of the system clock signal $\phi$ (step S20).

In practical use, if the frequency of the system clock signal $\phi$ is 40 MHz, the cycle time T of the system clock signal $\phi$ is 25 ns. The delay buffer in the delay buffer unit 63 can be composed of two inverter (NOT) gates connected in series, and the unit delay time $\Delta$ can be approximately 1 ns.

Therefore, the resolution number $n_1$ can be approximately 25, in other words, measurement accuracy can be remarkably high (time resolution=T/25). Almost all of the components of the time interval measurement system except for the MPU 17, such as delay buffers, shift registers, logic gates, counters, selectors, an adder, correction circuits, etc. can be composed of transistors. In conventional systems, time resolution of the system was restricted by cycle time of the clock of the system, and thus components of the system had to be composed of expensive high speed transistors such as ECL transistors. However, components of the system in FIG. 10 according to the present invention can be composed of cheap low speed transistors such as CMOS transistors, BiCMOS transistors, bipolar transistors, etc., since measurement accuracy of the system can be remarkably higher than the restriction by the cycle time T of the system clock signal $\phi$. However, the expensive high speed transistors such as ECL transistors may as well be used for the purpose of further raising measurement accuracy.

According to this embodiment, the remarkably high measurement accuracy can be obtained with smaller circuit scale than the system in FIG. 5, since use of 1-bit counters for obtaining the decimal part is made possible in this embodiment by adopting the second correction circuit 92. For example, when circuit scale of the system in FIG. 5 with resolution number $n_1$ is described as 100%, circuit scale of the system in FIG. 5 with resolution number $2\times n_1$ amounts approximately to 200%. However, the system in FIG. 10 with resolution number $2\times n_1$ can be realized with circuit scale of approximately 120%, since the second correction circuit 92 can be composed with small circuit scale.

Figure 17:
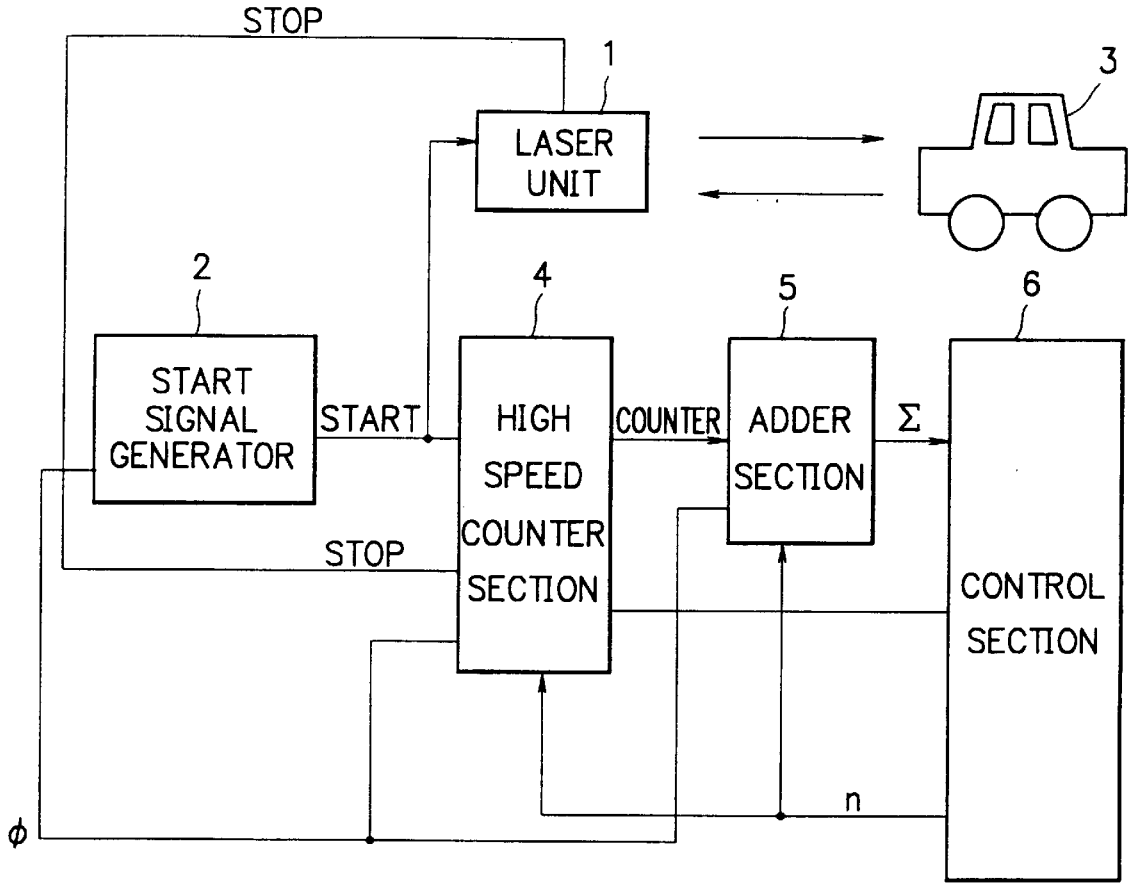
FIG. 17 is a block diagram showing another embodiment of the present invention.
Figure 18:
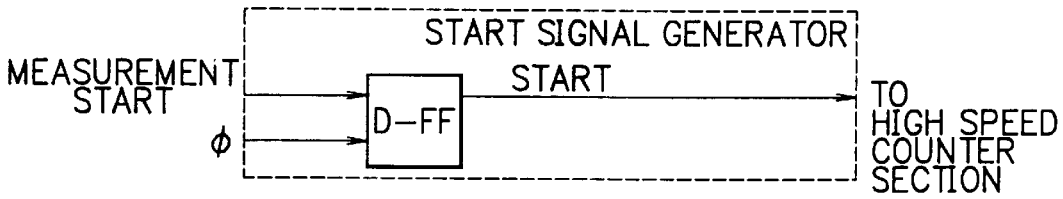
FIG. 18 is a schematic diagram showing composition of a START signal generator of the system of FIG. 17.

FIG. 17 is a block diagram showing another embodiment of the present invention. In this embodiment, the time interval measurement system of the first embodiment is applied to a system for measuring the distance between cars. The distance measurement system in FIG. 17 comprises a laser beam unit 1, a START signal generator 2, the high speed counter section 4 of the system of FIG. 10, the adder section 5 of the system of FIG. 10, and a control section 6'. FIG. 18 is a schematic diagram showing composition of the START signal generator 2. The START signal generator 2 is composed of a D-type flip-flop for generating the START signal quantized by the system clock signal $\phi$. The system for measuring the distance between cars is installed in a car which is following a car 3.

In the following, the operation of this embodiment will be described. The control section 6' periodically generates measurement start signals and sends the signals to the START signal generator 2. The measurement start signal received by the START signal generator 2 is latched in the D-type flip-flop and outputted as the START signal into the laser beam unit 1 and the high speed counter section 4 synchronized with the pulse of the system clock signal $\phi$. On receiving the START signal, the laser beam unit 1 emits a laser beam toward the car 3, and at the same moment, the high speed counter section 4 starts counting the number of pulses of the system clock signal $\phi$. Part of the laser beam is then reflected by the surface of the car 3 and part of the reflected beam is received by the laser beam unit 1. On receiving the reflected beam, laser beam unit 1 generates a STOP signal and sends the STOP signal to the high speed counter section 4. At the same moment, the high speed counter section 4 stops counting. Subsequently, a time interval between the START signal and the STOP signal is obtained in the same way as the first embodiment, and the control section 6' obtains the distance between cars by the equation A×C/2 (A: obtained time interval, C: the velocity of light).

The limit of distance which can be measured by the system corresponds to the number of bits of the m-bit counter for obtaining the integer part. In a general case where the frequency of the system clock signal $\phi$ is 25 MHz (cycle time T=25 ns), the laser beam proceeds 7.5 m in the cycle time T. If the m-bit counter is 6-bit counter, the 6-bit counter which can count 64 clocks can count a distance of 480 m, i.e. the distance between cars of 240 m. Therefore, use of 6-bit counter is enough for the system. If 8-bit counter is used, the limit of distance between cars becomes 960 m. Incidentally, usage of the system is not limited to cars, and the system may as well be applied to airplanes, ships, etc. The number of bits of the m-bit counter may be chosen according to the usage. Incidentally, if the frequency of the system clock signal $\phi$ is raised, the limit of distance decreases or the number of bits needed for the m-bit counter increases. However in the case where the distance measurement system in FIG. 17 is installed in cars for semi-automatic cruising, etc., the frequency of the system clock signal $\phi$ is restricted below 100 MHz in order to ensure safety, i.e. in order to eliminate malfunction of the system, in the present standard of manufacturing technique. Therefore, in the present standard, use of 6-bit counters or 8-bit counters is advantageous from a stand point of circuit scale and cost, for a system measuring the distance between cars.

Figure 19:
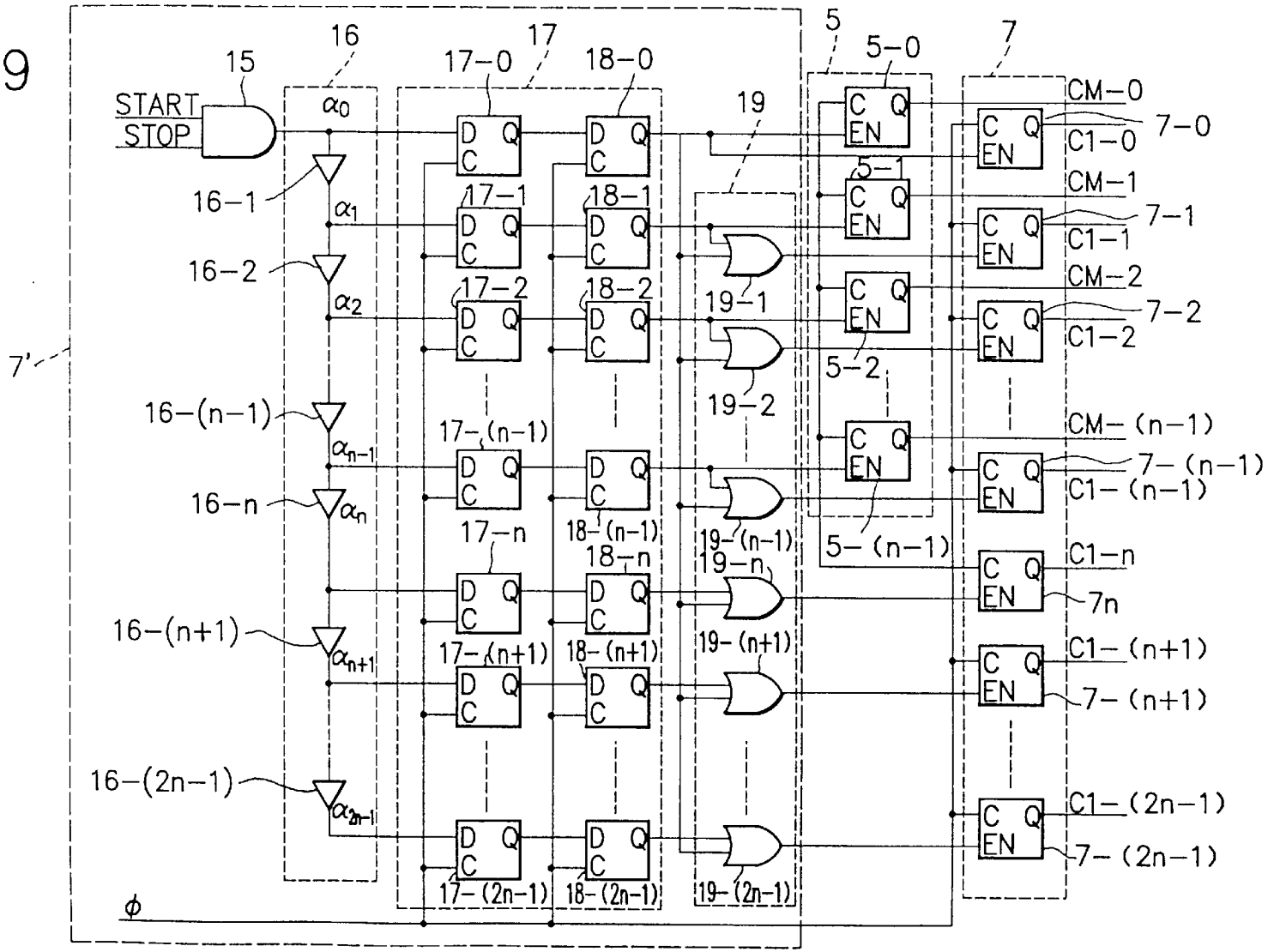
FIG. 19 is a block diagram showing another example of the high frequency pulse generator circuit according to the present invention.

FIG. 19 is a block diagram showing another example of the high frequency pulse generator circuit in the high speed counter section 4. In the first embodiment of FIG. 10, the START signal was supposed to be inputted to the high frequency pulse generator circuit 7 synchronized with the pulse of the system clock signal $\phi$, and if the START signal is inputted asynchronously, precision of obtained time interval is lowered. Use of the START signal generator 2 shown in the second embodiment can eliminate the asynchronous input of the START signal. However, such a system utilizing the START signal generator 2 can not measure a time interval starting with randomly inputted START signal. For such measurement, the high frequency pulse generator circuit 7' which is equivalent to the high frequency pulse generator circuit 7 in FIG. 11 may be adopted.

As set forth hereinabove, in the time interval measurement system and the time interval measurement method according to the present invention, use of 1-bit counters for obtaining the decimal part is made possible by adopting the second correction circuit for executing +2 correction. Therefore, measurement of individual time interval with remarkably improved measurement accuracy is realized with the time interval measurement system of considerably smaller circuit scale and reduced cost. The low-cost high-precision time interval measurement system can be used for distance measurement system such as a system installed in cars for measuring the distance between cars, and may make a large contribution to development of semi-automatic cruising system, automatic traffic system, etc.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A time interval measurement system comprising:

a high speed counter section including:

a m-bit counter unit having a plurality of m-bit counters for counting the number of pulses of a clock signal for obtaining an integer part of a time interval between a START signal and a STOP signal inputted to the high speed counter section, a first 1-bit counter unit having a plurality of first 1-bit counters for counting the number of pulses of the clock signal for obtaining an decimal part of the time interval, and a high frequency pulse generator circuit for periodically generating a plurality of delayed signals at intervals of a unit delay time which is shorter than the cycle time of the clock signal, according to the input of the START signal to the high speed counter section, and supplying each of a plurality of counter stop signals according to the delayed signals to a corresponding m-bit counter in the m-bit counter unit and a corresponding first 1-bit counter in the first 1-bit counter unit;

an adder section for executing addition of counted values of the m-bit counters in the m-bit counter unit and addition of counted values of the first 1-bit counters in the first 1-bit counter unit; and a control section for controlling the time interval measurement system, obtaining the integer part of the time interval by cutting off a decimal part of the average of the counted values of the m-bit counters using an output of the adder section, obtaining the decimal part of the time interval by cutting off an integer part of the average of the counted values of the first 1-bit counters using an output of the adder section, and obtaining the time interval by adding the integer part of the time interval and the decimal part of the time interval together and multiplying the added value by the cycle time of the clock signal, wherein the first 1-bit counter unit includes:

a first correction circuit for executing +1 correction to the counted values of the first 1-bit counters according to detection of involvement with a carry of a sequence of the counted values of the first 1-bit counters; and a second correction circuit for executing +2 correction to the counted values of the first 1-bit counters according to detection of involvement with return to an initial value of the sequence of the counted values of the first 1-bit counters.

2. A time interval measurement system as claimed in claim 1 further comprising a second 1-bit counter unit having a plurality of second 1-bit counters for counting the number of pulses of the clock signal, each of the second 1-bit counters being supplied with a corresponding counter stop signal from the high frequency pulse generator circuit, for obtaining a resolution number $n_1$ of the high frequency pulse generator circuit at the moment of measurement, wherein the resolution number $n_1$ is obtained by counting the number of second 1-bit counters in the longest sequence of the same counted value 1 or 0, and the addition of the counted values of the first 1-bit counters by the adder section is executed to first 1-bit counters corresponding to $n_1$ pieces of earlier counter stop signals.

3. A time interval measurement system as claimed in claim 1, wherein the high frequency pulse generator circuit includes:

a delay buffer unit composed of a cascade connection of a plurality of delay buffers for delaying the STOP signal inputted to the high speed counter section by the unit delay time;

a shift register unit having a plurality of shift registers to which outputs of the delay buffers are inputted respectively; and a logic gate unit having a plurality of logic gates for executing logic operation between each of the outputs of the shift registers and a signal related to the START signal and outputting the result.

4. A time interval measurement system as claimed in claim 3, wherein the delay buffer is composed of two NOT gates connected in series.

5. A time interval measurement system as claimed in claim 4, wherein the NOT gate is composed of ECL transistors.

6. A time interval measurement system as claimed in claim 1, wherein the adder section comprises:

a selector unit for selecting either the m-bit counter unit or the first 1-bit counter unit for input, selecting one of the counters in the selected counter unit one by one, and inputting a value corresponding to the selected counter into the adder section one by one; and an adder for adding the values inputted by the selector unit together.

7. A time interval measurement system as claimed in claim 6, wherein the adder is an incremental-type adder including:

a first latch for latching output of the selector unit;

an adder element whose one input terminal is supplied with data which has been latched by the first latch; and a second latch for latching output of the adder element and supplying its output to another input terminal of the adder element.

8. A time interval measurement system as claimed in claim 1, wherein the first correction circuit is composed of a plurality of EXOR gates whose one input terminal is supplied with a counted value of corresponding first 1-bit counter and whose another input terminal is supplied with a signal instructing the first correction circuit to execute +1 correction.

9. A time interval measurement system as claimed in claim 1, wherein the second correction circuit executes +2 correction by detecting return from 1 to 0 of the sequence of the counted values of the first 1-bit counters passed through the first correction circuit and adding 2 to the 0 which have returned from 1.

10. A time interval measurement system as claimed in claim 1, wherein the number of the first 1-bit counters is predetermined so that the number is not less than the cycle time of the clock signal divided by the shortest value of the unit delay time which is dependent on measurement circumstances.

11. A time interval measurement system as claimed in claim 1, wherein the number of the m-bit counters is a power of 2 and not less than 4.

12. A time interval measurement system as claimed in claim 11, wherein the number of the m-bit counters is 4.

13. A time interval measurement system as claimed in claim 1, wherein the number of the first 1-bit counters is reduced by utilizing the least significant digit of the m-bit counters as values of corresponding first 1-bit counters.

14. A time interval measurement system as claimed in claim 1, wherein the number of the second 1-bit counters is reduced by utilizing the least significant digit of the m-bit counters or values of the first 1-bit counters as values of corresponding second 1-bit counters.

15. A time interval measurement system as claimed in claim 1, wherein components of the system is composed of ECL transistors.

16. A time interval measurement system as claimed in claim 1, wherein components of the system is composed of CMOS transistors.

17. A time interval measurement system as claimed in claim 1 further comprising:

a START signal generator for generating the START signal which is synchronized with the clock signal; and a beam unit for emitting a beam according to input of the START signal, generating the STOP signal according to reception of the beam reflected by an object, and sending the generated STOP signal to the high speed counter section, wherein the system is provided with functions for obtaining the distance between the beam unit and the object using obtained time interval.

18. A time interval measurement system as claimed in claim 17, wherein the beam unit is a laser beam unit emitting and receiving a laser beam.

19. A time interval measurement system as claimed in claim 17, wherein the system is installed in a car and utilized for measurement of the distance between cars.

20. A time interval measurement system as claimed in claim 19, wherein the m-bit counter is a 6-bit counter or a 8-bit counter.

21. A time interval measurement method for measuring a time interval between a START signal and a STOP signal, in which the time interval is obtained by counting the number of pulses of a clock signal using a plurality of m-bit counters for obtaining an integer part of the time interval and a plurality of 1-bit counters for obtaining a decimal part of the time interval, comprising the steps of:

(1) starting counting of the number of pulses of the clock signal by the m-bit counters and 1-bit counters according to input of the start signal;

(2) generating a plurality of delayed signals at intervals of a unit delay time which is shorter than the cycle time of the clock signal, according to the input of the START signal, and supplying each of a plurality of counter stop signals according to the delayed signals to a corresponding m-bit counter and a corresponding first 1-bit counter on and on;

(3) stopping counting of the m-bit counters and 1-bit counters according to the counter stop signals on and on;

(4) starting addition of counted values of the m-bit counters;

(5) stopping the addition at a predetermined number of times and obtaining an added value;

(6) obtaining an average by dividing the added value by the predetermined number;

(7) obtaining the integer part of the time interval by cutting a decimal part of the average off;

(8) executing +1 correction to the counted values of the 1-bit counters according to detection of involvement with a carry of a sequence of the counted values of the 1-bit counters;

(9) executing +2 correction to the counted values of the 1-bit counters according to detection of involvement with return to an initial value of the sequence of the counted values of the 1-bit counters;

(10) starting addition of the corrected values from the 1-bit counters;

(11) stopping the addition at a predetermined number of times and obtaining an added value;

(12) obtaining an average by dividing the added value by the predetermined number;

(13) obtaining the decimal part of the time interval by cutting an integer part of the average off;

(14) obtaining the sum of the integer part obtained in the step (7) and the decimal part obtained in the step (13); and

(15) obtaining the time interval by multiplying the sum by the cycle time of the clock signal.

22. A time interval measurement method as claimed in claim 21, wherein counting by a plurality of second 1-bit counters for obtaining a resolution number $n_1$ is further executed in said step (1) through step (3), and the resolution number $n_1$ is obtained by counting the number of the second 1-bit counters in the longest sequence of the same counted value, and the stopping of the addition in said step (11) is executed at a number of times corresponding to $n_1$.

* * * * *